US009069285B2

(12) United States Patent
Shigemura et al.

(10) Patent No.: US 9,069,285 B2
(45) Date of Patent: Jun. 30, 2015

(54) DETECTION DEVICE AND IMAGE FORMING APPARATUS

(71) Applicant: CANON KABUSHIKI KAISHA, Tokyo (JP)

(72) Inventors: Yoshihiro Shigemura, Yokohama (JP); Shingo Horita, Yokosuka (JP); Masaaki Naoi, Yokosuka (JP); Megumi Uchino, Tokyo (JP); Mineto Yagyu, Hachioji (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/252,914

(22) Filed: Apr. 15, 2014

(65) Prior Publication Data

US 2014/0314434 A1 Oct. 23, 2014

(30) Foreign Application Priority Data

Apr. 22, 2013 (JP) ..... 2013-089617

(51) Int. Cl.
*G03G 15/00* (2006.01)
*G03G 15/08* (2006.01)

(52) U.S. Cl.
CPC ..... *G03G 15/0851* (2013.01)

(58) Field of Classification Search
CPC G03G 15/0848; G03G 15/0851; G03G 15/50
USPC ..... 399/27, 30, 55, 58, 61
See application file for complete search history.

(56) References Cited

U.S. PATENT DOCUMENTS

| | | | | |
|---|---|---|---|---|
| 5,006,897 | A | 4/1991 | Rimai et al. | |
| 8,275,277 | B2 | 9/2012 | Horita et al. | |
| 8,705,993 | B2 | 4/2014 | Mori et al. | |
| 2012/0051759 | A1 * | 3/2012 | Rimai et al. | 399/27 |

* cited by examiner

*Primary Examiner* — Walter N Lindsay, Jr.
*Assistant Examiner* — Jessica L Eley
(74) *Attorney, Agent, or Firm* — Fitzpatrick, Cella, Harper & Scinto

(57) ABSTRACT

In a detection device, in a case where toner on a developing material carrier is caused to adhere to an electrode, a controller connects an assembly havin a quartz oscillator to a first capacitor using a first switch and connects the assembly to a second capacitor using a second switch; and in a case where a detection unit detects the oscillation frequency of the quartz oscillator, the controller disconnects the assembly from the first capacitor using the first switch and disconnects the assembly from the second capacitor using the second switch.

14 Claims, 22 Drawing Sheets

DETECTION DEVICE AND IMAGE FORMING APPARATUS

BACKGROUND OF THE INVENTION

1. Field of the Invention

The present invention relates to detection devices and image forming apparatuses including such detection devices.

2. Description of the Related Art

In an image forming apparatus that forms an image by causing toner to adhere electrostatically to a photosensitive member, the density of the formed image will change if a charge amount of toner (called a "toner charge amount" hereinafter) changes due to temperature, humidity, or the like. In other words, more toner will adhere to the photosensitive member as the toner charge amount drops, and thus an image having a higher density than a desired density will be formed. On the other hand, less toner will adhere to the photosensitive member as the toner charge amount rises, and thus an image having a lower density than the desired density will be formed.

Accordingly, a method is known that controls image forming conditions such as an exposure light amount, a developing bias, and a charging potential for forming an electrostatic latent image on the photosensitive member based on a result of measuring the toner charge amount, in order to control the density of an image.

In U.S. Pat. No. 5,006,897, a probe including a piezoelectric crystal resonator (an oscillator) is caused to attract toner from a magnetic brush roller, and the toner charge amount is then calculated based on a mass calculated from a change in the frequency of the piezoelectric crystal resonator and a change in an amount of electric charge on the magnetic brush roller.

However, there is a problem in that when the probe is caused to attract the charged toner, an excessive voltage is applied to the oscillator that configures the probe, an oscillation circuit that drives the oscillator, and so on. As a result, the oscillator, the oscillation circuit, or the like will be damaged, electrodes will separate, and so on, and the toner charge amount cannot be measured.

SUMMARY OF THE INVENTION

According to one aspect of the present invention there is provided a detection device for detecting a charge amount of toner on a developing material carrier, the device comprising: an assembly including a quartz oscillator and a first electrode and a second electrode attached to the quartz oscillator; a first capacitor connected in series to the assembly; a first switch provided between the assembly and the first capacitor; a second capacitor connected in parallel to the assembly; a second switch connected in parallel to the assembly and connected in series to the second capacitor; a controller configured to control the first switch and the second switch; a first detection unit configured to detect a potential difference between both ends of the first capacitor; and a second detection unit configured to detect an oscillation frequency of the quartz oscillator, wherein in the case where the toner on the developing material carrier is caused to adhere to the first electrode, the controller is configured to connect the assembly to the first capacitor using the first switch and connect the assembly to the second capacitor using the second switch; and wherein in the case where the second detection unit detects the oscillation frequency of the quartz oscillator, the controller is configured to disconnect the assembly from the first capacitor using the first switch and disconnect the assembly from the second capacitor using the second switch.

According to another aspect of the present invention there is provided an image forming apparatus comprising: an image forming unit including a photosensitive member, an exposure unit configured to expose the photosensitive member to form a toner image, and a developing unit, including a bearing member configured to bear a toner, configured to develop an electrostatic latent image formed on the photosensitive member to form the toner image; an assembly including a quartz oscillator and a first electrode and a second electrode attached to the quartz oscillator; a first capacitor connected in series to the assembly; a first switch provided between the assembly and the first capacitor; a second capacitor connected in parallel to the assembly; a second switch connected in parallel to the assembly and connected in series to the second capacitor; a controller configured to control the first switch and the second switch; a first detection unit configured to detect a potential difference between both ends of the first capacitor; a second detection unit configured to detect an oscillation frequency of the quartz oscillator, and a determination unit configured to determine a charge amount of the toner on which the first electrode based on the potential difference detected by the first detection unit and the oscillation frequency detected by the second detection unit, wherein in the case where the toner on the bearing member is caused to adhere to the first electrode, the controller is configured to connect the assembly to the first capacitor using the first switch and connect the assembly to the second capacitor using the second switch; and wherein in the case where the second detection unit detects the oscillation frequency of the quartz oscillator, the controller is configured to disconnect the assembly from the first capacitor using the first switch and disconnect the assembly from the second capacitor using the second switch.

According to the present invention, an excessive voltage on an oscillator, an oscillation circuit, and so on can be suppressed, and thus the oscillator, the oscillation circuit, and so on can be prevented from being damaged, electrodes can be prevented from separating, and so on.

Further features of the present invention will become apparent from the following description of exemplary embodiments (with reference to the attached drawings).

DESCRIPTION OF THE EMBODIMENTS

First Embodiment

Apparatus Configuration

Figure 1:
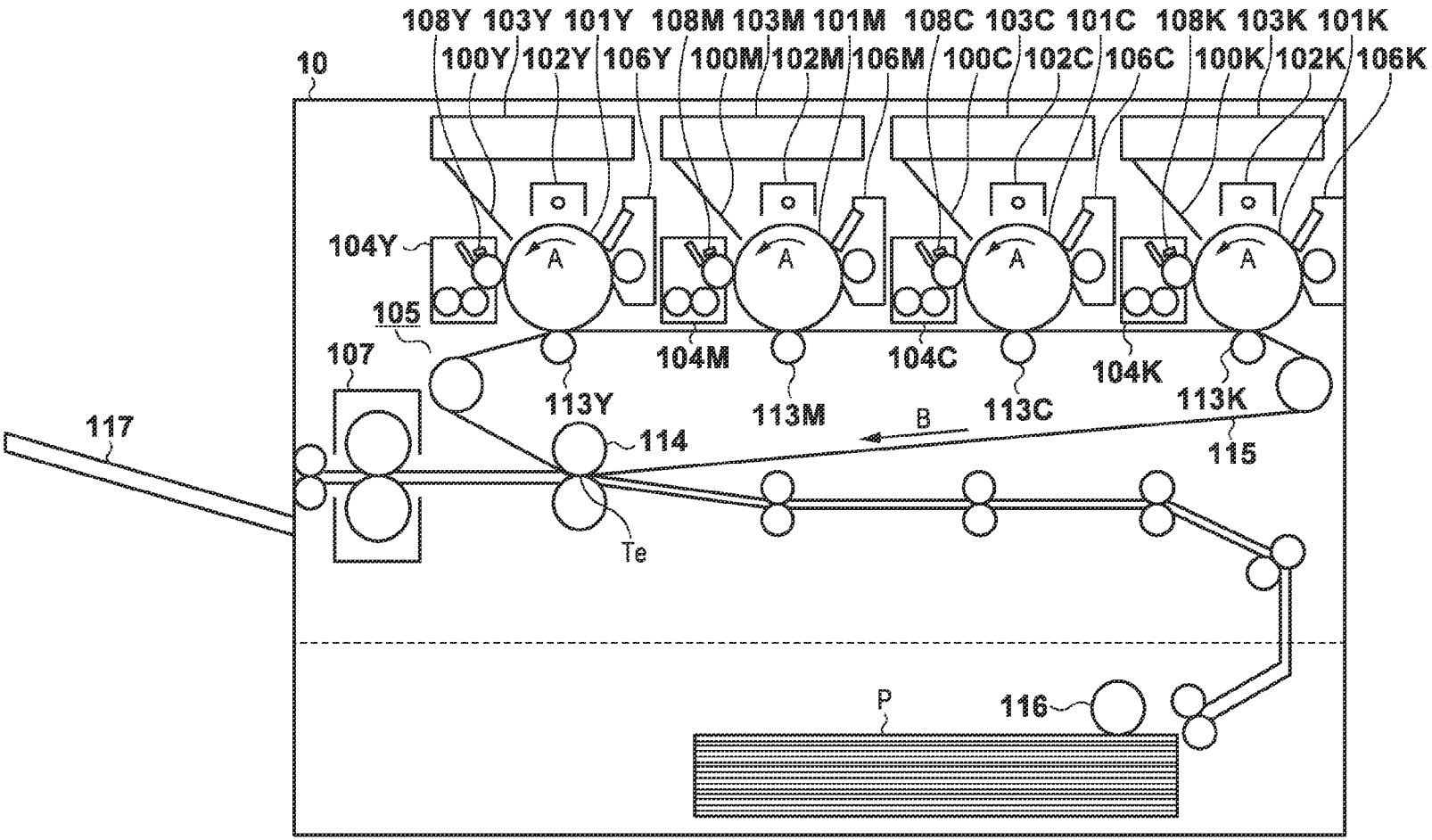
FIG. 1 is a diagram illustrating an overview of the configuration of an image forming apparatus.

FIG. 1 is a diagram illustrating the overall configuration of an electrophotographic image forming apparatus.

Charging apparatuses 102Y, 102M, 102C, and 102K, laser scanners 103Y, 103M, 103C, and 103K, developing apparatuses 104Y, 104M, 104C, and 104K, and drum cleaners 106Y, 106M, 106C, and 106K are arranged in the periphery of photosensitive drums 101Y, 101M, 101C, and 101K, respectively. Images of respective color components are formed upon the photosensitive drums 101Y, 101M, 101C, and 101K in an image forming process, which will be described later. Here, a yellow image is formed upon the photosensitive drum 101Y, a magenta image is formed upon the photosensitive drum 101M, a cyan image is formed upon the photosensitive drum 101C, and a black image is formed upon the photosensitive drum 101K. Meanwhile, primary transfer rollers 113Y, 113M, 113C, and 113K transfer the respective color component images onto an intermediate transfer belt 115 so that the images of the respective color components formed upon the photosensitive drums 101Y, 101M, 101C, and 101K are superimposed on the intermediate transfer belt 115. Here, the configurations of the photosensitive drums 101Y, 101M, 101C, and 101K, the charging apparatuses 102Y, 102M, 102C, and 102K, the laser scanners 103Y, 103M, 103C, and 103K, the developing apparatuses 104Y, 104M, 104C, and 104K, the drum cleaners 106Y, 106M, 106C, and 106K, and the primary transfer rollers 113Y, 113M, 113C, and 113K are the same, and thus the letters Y, M, C and K will be omitted in the following descriptions.

The photosensitive drum 101 includes a photosensitive member having a photosensitive layer on its surface, and is rotationally driven in the direction of an arrow A. When a print start signal is input, the photosensitive drum 101 begins rotating in the direction of the arrow A, and the charging apparatus 102 charges the surface of the photosensitive drum 101 to a predetermined potential. Then, an electrostatic latent image is formed upon the photosensitive drum 101 by the laser scanner 103 irradiating the photosensitive drum 101 with laser light 100 based on an image signal expressing an image to be printed. The developing apparatus 104 holds a developing material having toner and a carrier. The developing apparatus 104 develops the electrostatic latent image formed on the photosensitive drum 101 using the toner in the developing material. The image upon the photosensitive drum 101 (that is, a toner image) is, as a result of the photosensitive drum rotating in the direction of the arrow A, conveyed to a primary transfer nip area where the intermediate transfer belt 115 and the photosensitive drum 101 make contact with each other. A transfer voltage is applied to the toner image formed on the photosensitive drum 101 via a primary transfer roller 113, and the toner image is transferred onto the intermediate transfer belt 115 as a result.

The intermediate transfer belt 115 is rotationally driven in the direction of an arrow B. When the respective color component toner images are transferred in a superimposed manner from the respective photosensitive drums 101, a full-color toner image is formed on the intermediate transfer belt 115. Toner that is not transferred from the photosensitive drum 101 to the intermediate transfer belt 115 and remains on the photosensitive drum 101 is removed by the drum cleaner 106.

The toner image on the intermediate transfer belt 115 is conveyed to a secondary transfer nip area $T_e$ as a result of the rotation of the intermediate transfer belt 115. At this time, recording paper P held in a paper feed cassette is separated one sheet at a time by a paper feed roller 116, and is conveyed to the secondary transfer nip area $T_e$ by adjusting the timing so that the toner image on the intermediate transfer belt 115 and the recording paper P make contact with each other.

The toner image on the intermediate transfer belt 115 is transferred onto the recording paper P conveyed from the paper feed cassette at the secondary transfer nip area $T_e$ formed between a secondary transfer roller 114 and the intermediate transfer belt 115, and is fixed by a fixing apparatus 107 applying heat and pressure thereto. The recording paper P onto which the image has been fixed is discharged to a discharge tray 117.

In the present embodiment, a measurement process and an adjustment process are executed in parallel with the aforementioned image forming process. The measurement process is a process for measuring a mass M and an amount of electric charge Q of the toner immediately before development on the photosensitive drum 101, performed by a charge amount measurement unit 108 provided within the developing apparatus 104. The adjustment process is a process for controlling an amount of the laser light 100 emitted by the laser scanner 103 in order to form an image having a desired density, based on the mass M and the amount of electric charge Q of the toner measured in the measurement process.

Configuration of QCM Sensor

Figure 2A:
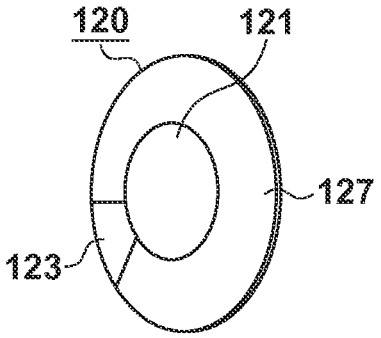
FIGS. 2A and 2B are diagrams illustrating an overview of the configuration of a QCM sensor.
Figure 2B:
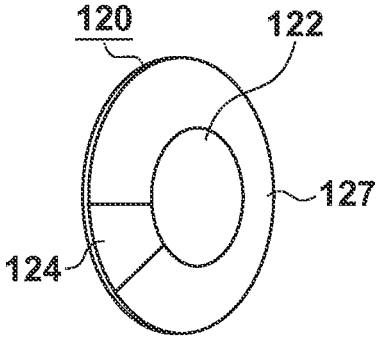

The configuration of a QCM sensor used in the present embodiment to measure the mass of the toner will be described using FIGS. 2A and 2B. FIGS. 2A and 2B are perspective views taken from the directions of two electrodes provided in the sensor. As shown in FIGS. 2A and 2B, a QCM sensor 120 is configured of a toner attracting surface electrode 121, a toner non-attracting surface electrode 122, a toner attracting surface-side electrode terminal 123, a toner non-attracting surface-side electrode terminal 124, and a quartz chip 127 (a quartz oscillator). The QCM sensor 120 is configured with the toner attracting surface electrode 121 provided on one surface (a first surface) thereof and the toner non-attracting surface electrode 122 provided on the other surface (a second surface, on the opposite side as the first surface) thereof. Note that the toner attracting surface electrode 121 corresponds to a first electrode and the toner non-attracting surface electrode 122 corresponds to a second electrode.

FIG. 2A is a diagram illustrating the configuration of the QCM sensor 120 on the surface on which the toner attracting surface electrode 121 is provided (the first surface). FIG. 2B is a diagram illustrating the configuration of the QCM sensor 120 on the surface on which the toner non-attracting surface electrode 122 is provided (the second surface). Note that the principles of measurement performed by the QCM sensor 120 are described in detail in, for example, Japanese Patent No. 3725195, and thus only an overview will be given here.

In the QCM sensor 120, when a voltage is applied to the quartz chip 127 via the electrode terminals 123 and 124, thickness shear vibrations are induced in the quartz chip 127 due to a reverse piezoelectric effect of the quartz. Here, the resonance frequency of the QCM sensor 120 has a value equal to the resonance frequency of the quartz chip 127 when no toner adheres to the toner attracting surface electrode 121. However, when toner adheres to the toner attracting surface electrode 121, the resonance frequency of the QCM sensor 120 changes in accordance with the amount of toner adhering to the toner attracting surface electrode 121. Accordingly, the amount of toner adhering to the toner attracting surface electrode 121 can be measured based on the amount of change in the resonance frequency.

Generally speaking, the relationship between a change in mass $\Delta M$ of attracted objects and a change in resonance frequency $\Delta f$ in a QCM device employing a quartz oscillator is known to be expressed by Sauerbrey's equation, indicated by the following Formula 1.

$$\Delta f = -\frac{2 \times f_0^2}{\sqrt{\rho \times \mu}} \times \frac{\Delta M}{B} \quad (1)$$

Here, $f_0$ represents the resonance frequency of the oscillator, $\rho$ represents the density of the quartz ($2.649\times10^3$ kg/m$^3$), $\mu$ represents the shearing stress of the quartz ($2.947\times10^{10}$ kg/ms$^2$), and B represents the active vibrating surface area (approximate electrode surface area).

For example, in the case where the amount of change in the frequency is 1 Hz ($\Delta f$=1 Hz) when toner is attracted to the electrode of an oscillator whose resonance frequency is 10 MHz ($f_0$=10 MHz), approximately 5 ng/cm$^2$ of toner has adhered to the electrode.

In FIG. 2A, the toner attracting surface electrode 121 and the electrode terminal 123 formed on the first surface of the quartz chip 127 are electrically connected seamlessly. Likewise, in FIG. 2B, the toner non-attracting surface electrode 122 and the electrode terminal 124 formed on the second surface of the quartz chip 127 are electrically connected seamlessly. The toner attracting surface electrode 121 and the toner non-attracting surface electrode 122 are electrically connected to the corresponding electrode terminals 123 and 124. Note that the surfaces of the electrode terminals 123 and 124 are covered with an insulating material so as not to be affected by electrical disturbance components.

Configuration of Developing Apparatus

Figure 3:
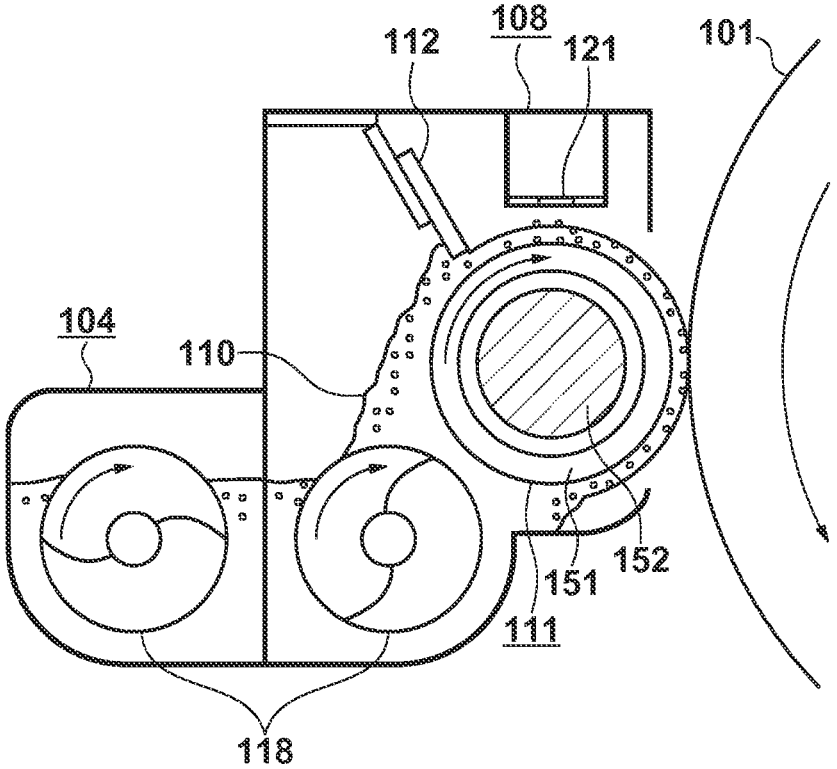
FIG. 3 is a diagram illustrating an overview of the configuration of a developing apparatus.

FIG. 3 is a cross-sectional view illustrating the primary components of the developing apparatus 104.

A developing material 110 is a dual-component developing material configured primarily of the toner and the carrier. An agitating screw 118 conveys the developing material 110 in the developing apparatus 104 to a developing sleeve 111 while frictionally electrifying the toner and the carrier within the developing material 110. The developing sleeve 111 is configured of a nonmagnetic cylinder member 151 capable of rotation and a magnet 152 exhibiting magnetism. The magnet 152 is housed within the cylinder member 151. The magnetism of the magnet 152 housed within the developing sleeve 111 pulls the developing material 110 to the surface. In other words, the developing sleeve 111 corresponds to a developing material carrier. Furthermore, the developing sleeve 111 conveys the developing material 110 downstream in a rotation direction indicated by an arrow as a result of the cylinder member 151 rotating. The developing material 110 borne by the developing sleeve 111 passes through a small, constant gap formed between the developing sleeve 111 and a regulation blade 112, regulating the amount of the developing material 110 borne by the developing sleeve 111. In addition, when the developing material 110 passes through the small gap, friction is produced between the toner and carrier and the regulation blade 112, increasing the charge amount of the toner as a result.

The charge amount measurement unit 108 is configured to house the QCM sensor 120 so that the toner within the developing apparatus 104 does not adhere to the toner non-attracting surface electrode 122 of the QCM sensor 120. The charge amount measurement unit 108 is disposed downstream from the regulation blade 112 in the rotation direction of the developing sleeve 111, and in a position upstream from a developing position where the developing sleeve 111 is closest to the photosensitive drum 101. Furthermore, the charge amount measurement unit 108 is disposed so that the toner attracting surface electrode 121 does not make contact with the developing material 110 upon the developing sleeve 111. In the present embodiment, a distance between the toner attracting surface electrode 121 and the developing sleeve 111 is several mm or less, for example.

Description of Toner Charge Amount

Figure 4:
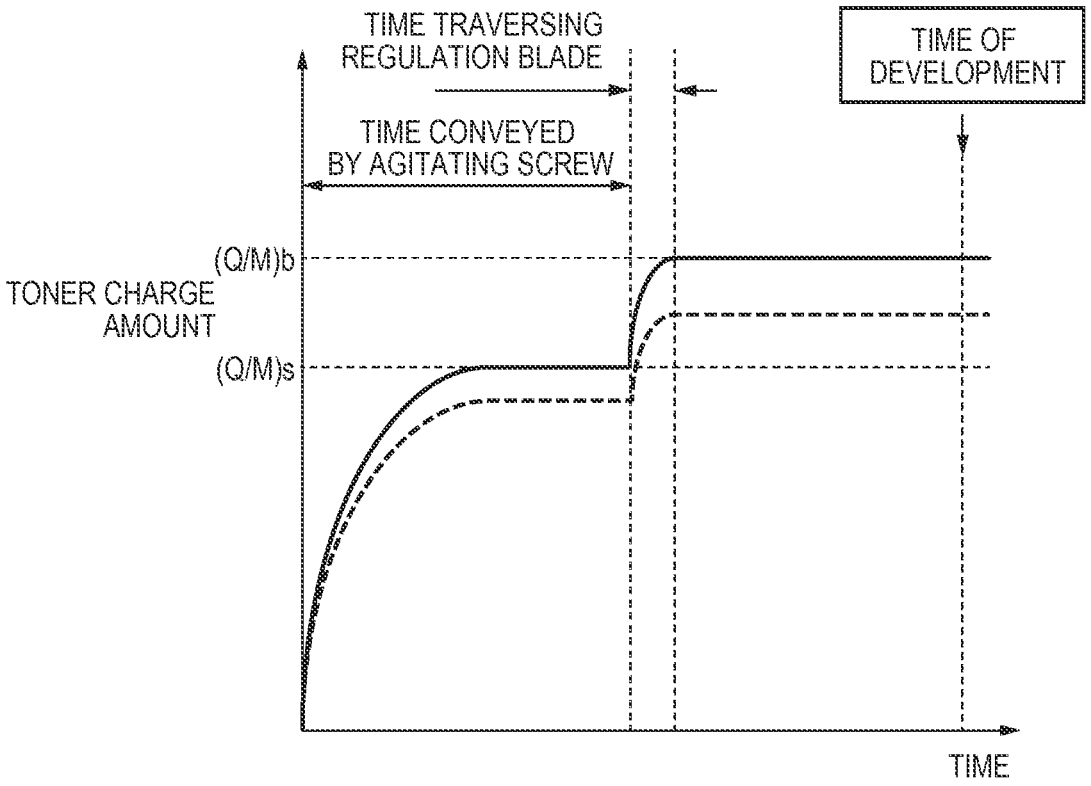
FIG. 4 is a diagram illustrating a charge amount of toner in the developing apparatus.

FIG. 4 is a diagram illustrating a change in the charge amount of the toner within the developing apparatus 104. In FIG. 4, the horizontal axis represents time, and the vertical axis represents the charge amount of the toner. Note that a solid line indicates a change in the charge amount of the toner having desired charge properties, whereas a broken line indicates a change in the charge amount of the toner having charge properties that are lower than the desired charge properties. Upon being agitated by the agitating screw 118, the toner supplied to the developing apparatus 104 is charged to a predetermined value $(Q/M)_s$ as a result of friction between toner molecules. Then, when the toner supply to the developing sleeve 111 traverses the regulation blade 112, the toner is further charged, and the charge amount of the toner on the developing sleeve 111 rises to a target value $(Q/M)_b$. Note that the toner charge amount target value $(Q/M)_b$ corresponds to a theoretical value of the charge amount of the toner on the developing sleeve 111 in the case where the toner within the developing apparatus 104 has the desired charge properties.

On the other hand, the charge amount of the toner that has the charge properties that are lower than the desired charge properties does not increase to the target value $(Q/M)_b$ even if the toner supplied to the developing sleeve 111 traverses the regulation blade 112. In other words, in the case where the toner does not have the desired charge properties, the amount of toner adhering to the electrostatic latent image on the photosensitive drum 101 will change. A toner image developed by toner whose charge amount is less than the target value $(Q/M)_b$ will not have a desired density, color, and so on.

The temperature, humidity, and so on in the installation environment of the image forming apparatus, deterioration over time in the carrier due to long-term use, fluctuations in the amount of toner consumed and refilled, and so on can be given as examples of factors that cause fluctuations in the charge properties, or in other words, examples of factors that cause fluctuations in the toner charge amount (Q/M). Furthermore, if the toner is left for long periods of time without the image forming apparatus being used, it is possible that the charge amount of the toner in the image forming apparatus cannot be increased to the target value when the image forming apparatus is once again used to form images. In this case, the agitating screw can increase the toner charge amount to the target toner charge amount if the image forming is to be continued.

The charge amount of the toner within the developing apparatus 104 gradually changes due to environmental changes, the passage of time, and so on. On the other hand, the toner charge amount will change in a short amount of time immediately after the image forming apparatus is started up after being left without use for a long period of time. Furthermore, the toner charge amount will change in a short amount of time in the case where the amount of toner in the developing apparatus 104 has dropped drastically or the case where the toner is agitated after the amount thereof has increased drastically. In the case where the toner charge amount changes in a short amount of time, the toner charge amount (Q/M) will fluctuate within a single page's worth of an image, which can result in images having uneven density being formed.

For example, in the case where an electrostatic latent image is developed into a toner image using toner whose charge amount (Q/M) is lower than the target value $(Q/M)_b$, the electrostatic adhesive force of the toner will drop. As a result, the amount of toner adhering to the photosensitive drum 101 will increase, resulting in an increase in the density of the output image. Conversely, in the case where an electrostatic latent image is developed into a toner image using toner whose charge amount (Q/M) is higher than the target value $(Q/M)_b$, the electrostatic adhesive force of the toner will rise, and thus the amount of toner adhering to the photosensitive drum 101 will decrease, resulting in a decrease in the density of the output image.

Even if the toner charge amount (Q/M) has fluctuated, the charge amount (Q/M) of the toner borne on the developing sleeve 111 can be measured, and thus the image forming conditions can be found based on the charge amount of the toner used in the development. In other words, the image forming conditions for forming the toner image at the desired density can be determined based on the charge amount of the toner on the developing sleeve 111. In the present embodiment, the amount of toner adhering to the photosensitive drum 101 is controlled in accordance with the toner charge amount (Q/M) by controlling, for example, the pulse timing of the laser light 100 emitted from the laser scanner 103, which can undergo feedback in a short amount of time, as the image forming condition.

Overview of Q/M Measurement

Next, a method for measuring the charge amount Q/M of the toner will be described.

Figure 9:
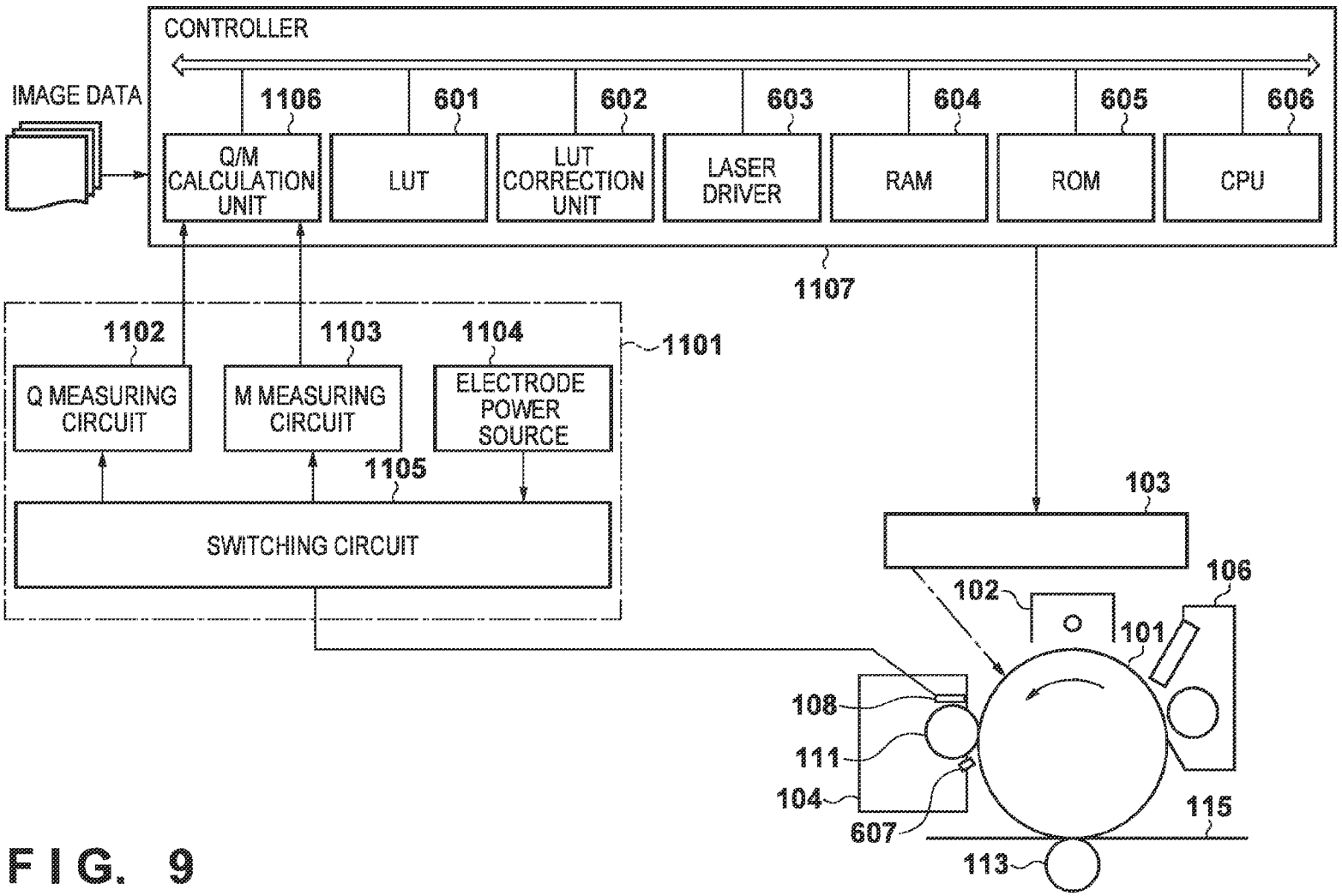
FIG. 9 is a control block diagram illustrating an image forming station according to a first embodiment.

FIG. 9 is a control block diagram illustrating the configuration of an image forming station, which includes the photosensitive drum 101, the charging apparatus 102, the laser scanner 103, the developing apparatus 104, the drum cleaner 106, and the primary transfer roller 113, as well as a Q/M measuring unit 1101 and a controller 1107. The photosensitive drum 101 represents the photosensitive drums 101Y, 101M, 101C, and 101K illustrated in FIG. 1. Likewise, the charging apparatus 102, the laser scanner 103, the developing apparatus 104, the drum cleaner 106, and the primary transfer roller 113 represent the corresponding units illustrated in FIG. 1. Note that the configuration of the Q/M measuring unit 1101 will be described in detail using FIG. 11.

The controller 1107 includes a Q/M calculation unit 1106, an LUT (lookup table) 601, an LUT correction unit 602, a laser driver 603, a RAM 604, a ROM 605, and a CPU 606. The LUT 601 determines a laser driving signal in accordance with an image signal. Note that the laser driving signal is a signal input into the laser scanner 103 in order to control the pulse timing of the laser light 100 emitted from the laser scanner 103. The LUT 601 is a conversion unit that converts the image signal into the laser driving signal using a conversion table (called an "LUT" hereinafter). The LUT correction unit 602 corrects the LUT used by the LUT 601 to determine the laser driving signal in accordance with the image signal. A method for correcting the LUT will be described later. The laser driver 603 outputs the laser driving signal determined by the LUT 601 to the laser scanner 103. The RAM 604 is a storage unit that holds data that can be rewritten. The ROM 605 is a storage unit that holds pre-set data. The CPU 606 carries out control of and computations for the image forming apparatus as a whole.

Next, a toner charge amount measurement sequence will be described based on FIG. 10. In the present embodiment, the controller 1107 detects the charge amount Q/M of the toner on the developing sleeve 111 while an image is being formed based on image data.

In S1301, the controller 1107 causes the Q/M measuring unit 1101 to charge a Q measurement capacitor C1 (see FIG. 11) in a Q measuring circuit 1102 to a potential at which the toner is electrostatically attracted to the toner attracting surface electrode 121 (called a "toner attracting potential" hereinafter). In the present embodiment, the toner attracting surface electrode 121 attracts the toner on the developing sleeve 111 using the toner attracting potential to which the Q measurement capacitor C1 (see FIG. 11) has been charged. This is because if an electrode power source 1104 supplies power to the toner attracting surface electrode 121 directly in order to attract the toner to the toner attracting surface electrode 121, the charge of the toner will be discharged from the electrode power source 1104. Note that details of this process will be given later using FIG. 13.

In S1302, the controller 1107 removes the toner adhering to the toner attracting surface electrode 121. In other words, the controller 1107 uses the Q/M measuring unit 1101 to control the surface potential of the toner attracting surface electrode 121 to a potential at which the toner will separate (called a "toner separating potential" hereinafter), causing the toner adhering to the toner attracting surface electrode 121 to electrostatically separate therefrom. Details of this process will be given later using FIG. 14. In S1303, the controller 1107 causes the Q/M measuring unit 1101 to measure a reference value V1 of a potential difference between both ends of the Q measurement capacitor C1 charged in S1301 prior to the toner being attracted to the toner attracting surface electrode 121 and a reference value f1 of the oscillation frequency of the quartz chip 127. Details of this process will be given later using FIG. 15. In S1304, the controller 1107 uses the Q/M measuring unit 1101 to cause the toner to be attracted to the toner attracting surface electrode 121 due to the toner attracting potential to which the Q measurement capacitor C1 (see FIG. 11) of the Q measuring circuit 1102 has been charged. Details of this process will be given later using FIG. 16.

Figure 17:
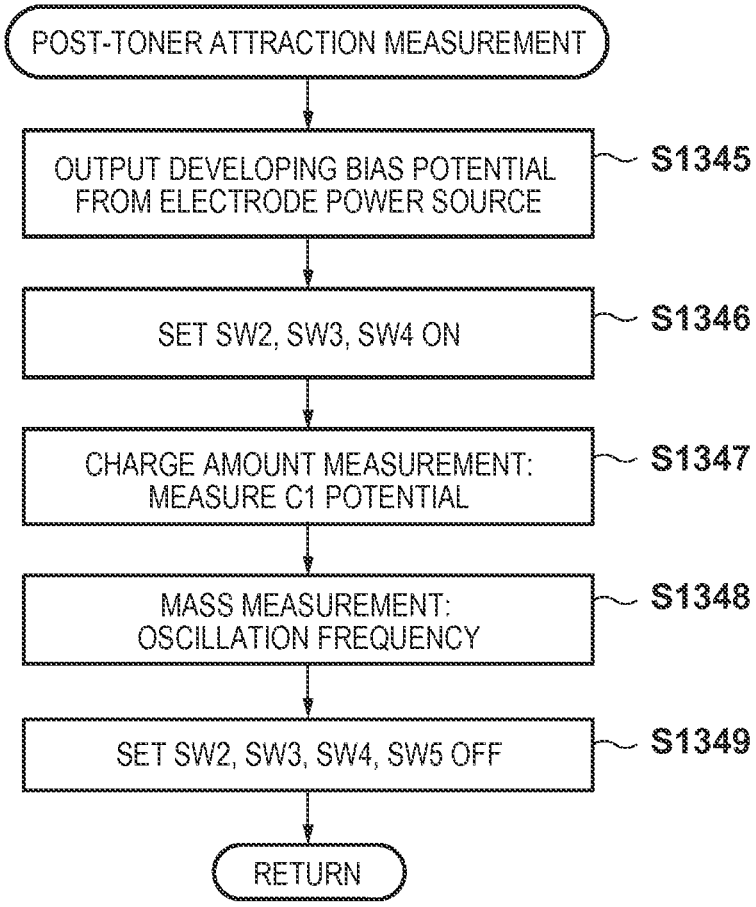
FIG. 17 is a flowchart illustrating a post-toner attraction measurement sequence according to the first embodiment.

In S1305, the controller 1107 causes the Q/M measuring unit 1101 to measure a potential difference V2 between both ends of the Q measurement capacitor C1 while the toner is attracted to the toner attracting surface electrode 121 and an oscillation frequency f2 of the quartz chip 127 while the toner is attracted to the toner attracting surface electrode 121. Details of this process will be given later using FIG. 17. In S1306, the controller 1107 uses the Q/M calculation unit 1106 to detect the charge amount Q/M of the toner adhering to the toner attracting surface electrode 121. In other words, the Q/M measuring unit 1101 measures the amount of electric charge Q of the toner attracted to the toner attracting surface electrode 121 based on the reference value V1 and the potential difference V2, and measures the mass M of the toner adhering to the toner attracting surface electrode 121 based on the reference value f1 and the oscillation frequency f2. Then, the Q/M calculation unit 1106 of the controller 1107 calculates the charge amount Q/M of the toner attracted to the toner attracting surface electrode 121 based on the amount of electric charge Q and the mass M measured by the Q/M measuring unit 1101. Note that a value obtained by dividing the amount of electric charge Q by the mass M corresponds to the charge amount Q/M of the toner. Then, in S1307, the controller 1107 determines whether to end the measurement or carry out the next measurement. In the present embodiment, the toner charge amount Q/M continues to be measured while the image forming process is being carried out. In other words, in S1307, the controller 1107 returns the processing to S1301 in the case where the image forming process is being executed, and ends the toner charge amount measurement sequence in the case where the image forming process has ended.

Note that the amount of toner attracted to the toner attracting surface electrode 121 in a single measurement is an extremely small amount, from several μg to several tens of μg, and thus does not affect the density of the image formed on the photosensitive drum.

The LUT correction unit 602 corrects the LUT based on the measured toner charge amount Q/M. The laser driver 603 sets the pulse timing of the laser light 100 in accordance with the content of the LUT 601. When the laser scanner 103 exposes the photosensitive drum 101 with the laser light 100 whose pulse timing has been adjusted, an electrostatic latent image suited to the toner charge amount Q/M is formed upon the photosensitive drum 101.

Hereinafter, the electrical properties of the QCM sensor 120 will be described.

QCM Equivalent Capacity

Figure 5:
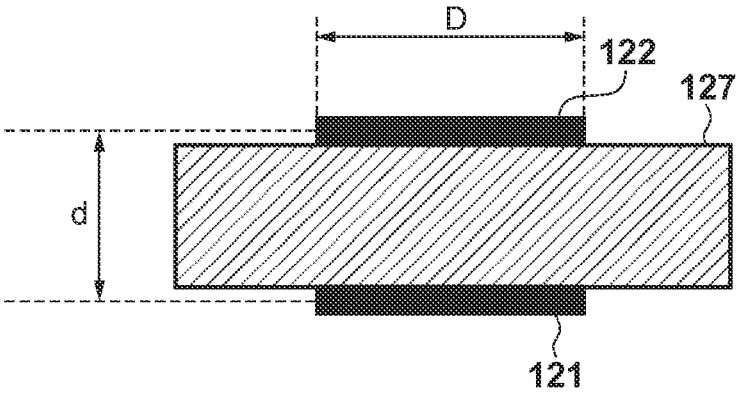
FIG. 5 is a cross-sectional view of the QCM sensor.
Figure 6:
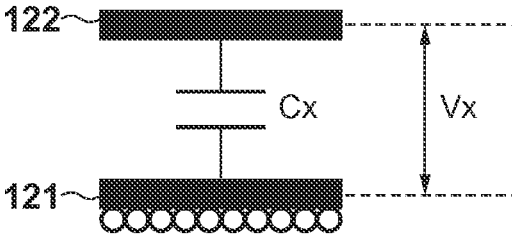
FIG. 6 is an equivalent circuit diagram illustrating the QCM sensor.

FIG. 5 is a cross-sectional view of the QCM sensor 120. The QCM sensor 120 is configured having the quartz chip 127 interposed between two electrodes, and thus is the same as a capacitance Cx shown in an equivalent circuit illustrated in FIG. 6.

Here, when a diameter of the electrodes is represented by D (mm), a distance between the electrodes is represented by d (mm), a dielectric constant of the quartz piezoelectric crystal is represented by ∈(F/m), and a capacitance is represented by Cx (F), the capacitance Cx can be found through the following Formula 2.

$$Cx = \varepsilon \frac{\pi \times \left(\frac{D}{2}\right)^2}{d} \tag{2}$$

For example, in the case where D=3.2 mm, d=0.3 mm, and $\in=4.1\times10^{-11}$ F/m, the capacitance Cx is expressed as:

$$Cx=4.1\times10^{-11}\times\pi\times[3.2/2]^2/0.3=1.10\text{ pF}$$

Potential During Toner Attraction

If it is assumed that the charge of a single molecule of toner is $4\times10^{-15}$ C and the toner has adhered to the toner attracting surface electrode 121 uniformly, the number of toner molecules will be 270,557. Thus the total amount of electric charge Q of the toner attracted to the toner attracting surface electrode 121 will be $1.08\times10^{-9}$ C. If toner having a charge of $1.08\times10^{-9}$ C is attracted to the toner attracting surface electrode 121 with the equivalent capacitance Cx in FIG. 6 at 1.1 pF, a potential Vx will be $Vx=Q/Cx=1.08\times10^{-9}/1.1\times10^{-12}=981.8$ V.

In other words, in the case where the toner is assumed to be attracted uniformly across the entire surface of the toner attracting surface electrode 121, a potential of approximately 1000 V is produced between the toner attracting surface electrode 121 and the toner non-attracting surface electrode 122. There is thus a problem that an excessive voltage will be applied to the quartz chip 127 interposed between the electrodes, an oscillation circuit 1233, and so on. Accordingly, in the present embodiment, an excessive voltage is suppressed from being applied to the quartz chip 127, the oscillation circuit 1233, and the like by connecting a capacitor Cv for excessive voltage protection.

Figure 7:
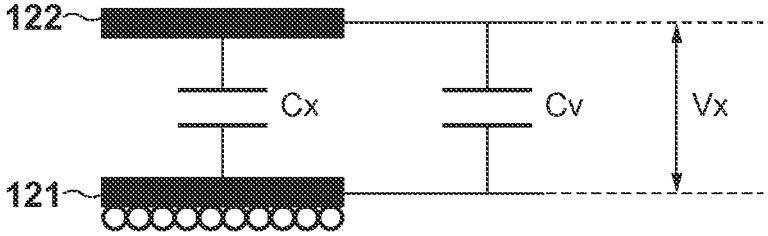
FIG. 7 is an equivalent circuit diagram to which an excessive voltage protection capacitor Cv has been added.

FIG. 7 is an equivalent circuit diagram in which the excessive voltage protection capacitor Cv is connected in parallel to Cx, which corresponds to the QCM sensor 120. Here, the capacitance of the excessive voltage protection capacitor Cv is simply denoted as Cv. In FIG. 7, the capacitors Cx and Cv are connected in parallel, and thus the capacitance formed between the toner attracting surface electrode 121 and the toner non-attracting surface electrode 122 is equivalent to Cx+Cv. For example, when the excessive voltage protection capacitor Cv whose capacitance is 1000 pF is connected in parallel to Cx=1.1 pF, the overall capacitance will be Cx+Cv=1001.1 pF.

Furthermore, for example, in the case where the amount of electric charge Q is $1.08\times10^{-9}$ C when the toner adheres uniformly to the toner attracting surface electrode 121, the voltage Vx produced between the toner attracting surface electrode 121 and the toner non-attracting surface electrode 122 is $Vx=Q/C=1.08\times10^{-9}/1001.1\times10^{-12}=1.08$ V.

Note that the capacitance of the excessive voltage protection capacitor Cv is determined based on the size of the toner attracting surface electrode 121, the amount of electric charge of the toner, and the electric strength of the QCM sensor 120. Specifically, in the case where the capacitance of the excessive voltage protection capacitor Cv is represented by Cv, a maximum amount of electric charge corresponding to an estimated maximum value of the toner attracted to the toner attracting surface electrode 121 is represented by Qmax, and the electric strength of the QCM sensor 120 is represented by Vmax, the configuration is such that Vmax>Qmax/Cv.

Detailed Description of Q/M Measuring Unit

Next, the respective processes in the toner charge amount measurement sequence shown in FIG. 10 will be described in detail. Note that FIG. 11 is a circuit diagram illustrating the Q/M measuring unit 1101, and FIG. 12 is a timing chart illustrating timings at which a switching circuit 1105 is switched on and off.

Figure 11:
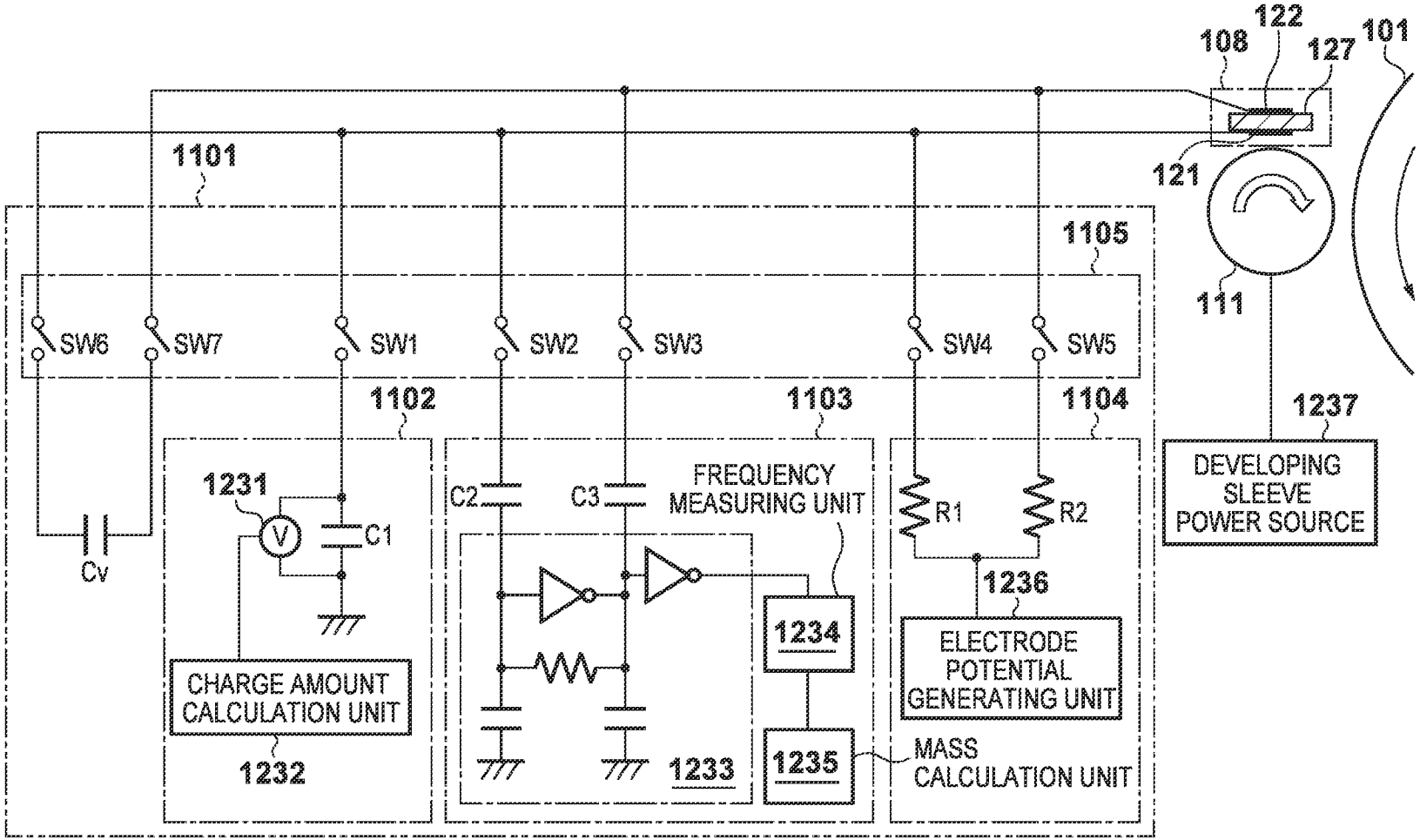
FIG. 11 is a circuit diagram illustrating a Q/M measuring unit according to the first embodiment.
Figure 12:
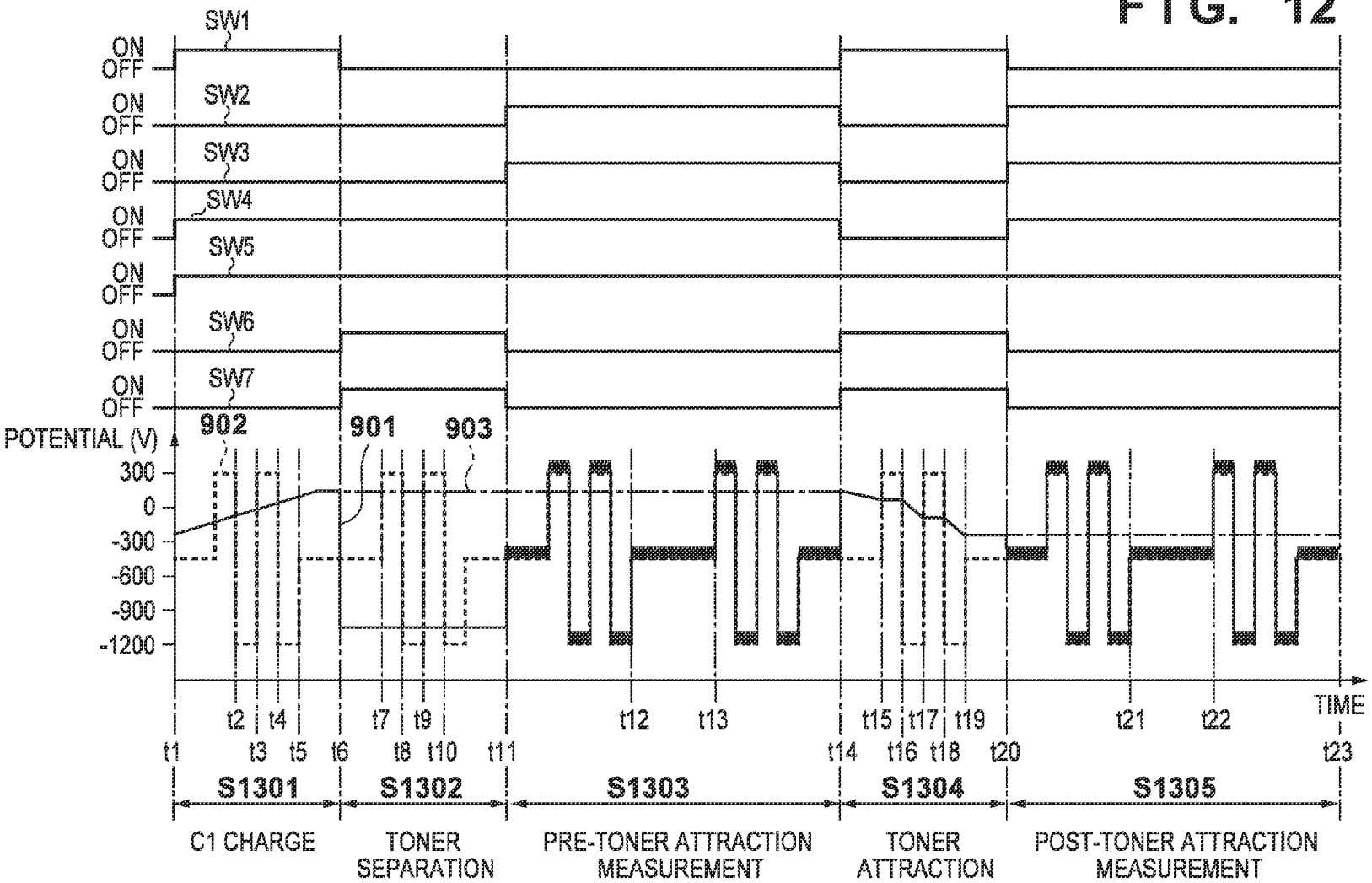
FIG. 12 is a timing chart according to the first embodiment.

Referring to FIG. 11, a switch SW1 electrically connects or disconnects the Q measuring circuit 1102 to or from the toner attracting surface electrode 121. A switch SW2 electrically connects or disconnects an M measuring circuit 1103 to or from the toner attracting surface electrode 121. A switch SW3 electrically connects or disconnects the M measuring circuit 1103 to or from the toner non-attracting surface electrode 122. A switch SW4 electrically connects or disconnects the electrode power source 1104 to or from the toner attracting surface electrode 121. A switch SW5 electrically connects or disconnects the electrode power source 1104 to or from the toner non-attracting surface electrode 122.

A switch SW6 electrically connects or disconnects the excessive voltage protection capacitor Cv to or from the toner attracting surface electrode 121. A switch SW7 electrically connects or disconnects the excessive voltage protection capacitor Cv to or from the toner non-attracting surface electrode 122.

The Q measurement capacitor C1 is a capacitor for measuring the amount of electric charge Q, and is charged to the toner attracting potential. A capacitor C2 is a coupling capacitor that is inserted between the toner attracting surface electrode 121 and the M measuring circuit 1103, and that transmits only a high-frequency oscillation signal. A capacitor C3 is a coupling capacitor that is inserted between the toner non-attracting surface electrode 122 and the M measuring circuit 1103, and that transmits only a high-frequency oscillation signal, like the capacitor C2. A capacitor C4 is an excessive voltage protection capacitor that prevents an excessive voltage from being supplied between the toner attracting surface electrode 121 and the toner non-attracting surface electrode 122 when charging for toner attraction.

Resistances R1 and R2 are resistances for preventing the toner attracting surface electrode 121 and the toner non-attracting surface electrode 122 from shorting when an electrode potential generating unit 1236 is connected to the electrodes. An electrometer 1231 is an electrometer that measures the potential of the Q measurement capacitor C1. A charge amount calculation unit 1232 calculates the amount of electric charge Q based on a difference (V1−V2) between a potential difference V1 (a reference value) between both ends of the Q measurement capacitor C1 measured before the toner attraction and the potential difference V2 between both ends of the Q measurement capacitor C1 measured while toner is attracted. In other words, the charge amount calculation unit 1232 corresponds to a charge amount detecting unit that detects an amount of electric charge of the toner attracted to the toner attracting surface electrode 121 based on a change in the potential difference between both ends of the Q measurement capacitor C1 when toner is attracted to the toner attracting surface electrode 121. The oscillation circuit 1233 oscillates the quartz chip 127. Note that the oscillation circuit 1233 used in the present embodiment is configured of a logic IC, a resistance, and a capacitor. However, the configuration of the oscillation circuit 1233 is not necessarily limited to this configuration, and another oscillation circuit may be used instead.

A frequency measuring unit 1234 measures an oscillation frequency of the oscillation circuit 1233. A mass calculation unit 1235 calculates the mass M from a difference (f1−f2) between the oscillation frequency f1 measured before the toner is attracted and the oscillation frequency f2 measured after the toner has been attracted. In other words, the mass calculation unit 1235 corresponds to a mass detecting unit that detects the mass of the toner attracted to the toner attracting surface electrode 121. The electrode potential generating unit 1236 outputs the toner attracting potential, the developing bias, the toner separating potential, a 0V potential, and so on. A developing sleeve power source 1237 applies the developing bias to the developing sleeve 111.

The timing chart in FIG. 12 illustrates a relationship between the surface potential of the developing sleeve 111, the surface potential of the toner attracting surface electrode 121, the potential difference between both ends of the Q measurement capacitor C1, and the on/off states of the switches SW1, SW2, SW3, SW4, SW5, SW6, and SW7. A solid line 901 indicates the surface potential of the toner attracting surface electrode 121. A dotted line 902 indicates the surface potential of the developing sleeve 111. A dot-dash line 903 indicates the potential difference between both ends of the Q measurement capacitor C1. Note that because the Q measurement capacitor C1 is grounded, the potential indicated by the dot-dash line 903 corresponds to the potential of the Q measurement capacitor C1 itself.

In the present embodiment, the developing sleeve power source 1237 applies, to the developing sleeve 111, the developing bias that alternates between a pulse period in which a voltage value changes cyclically between +300 V and −1200 V, for example, and a blank period in which the voltage value is constant (the developing bias will be referred to as a "blank pulse" hereinafter). Note that a DC component of the developing bias is −450 V. Note also that it is assumed that the blank period is one pulse, for the sake of simplicity. Meanwhile, it is furthermore assumed that there are one or two pulses in each sequence, for descriptive purposes. S1301 to S1305 in FIG. 12 indicate the numbers of each sequence in the toner charge amount measurement sequence shown in FIG. 10.

Hereinafter, the respective steps in the toner charge amount measurement sequence (FIG. 10) will be described in detail with reference to the flowcharts in FIGS. 13 to 17, the circuit diagram in FIG. 11, and the timing chart in FIG. 12.

Charging of Toner Attracting Potential (S1301)

Figure 10:
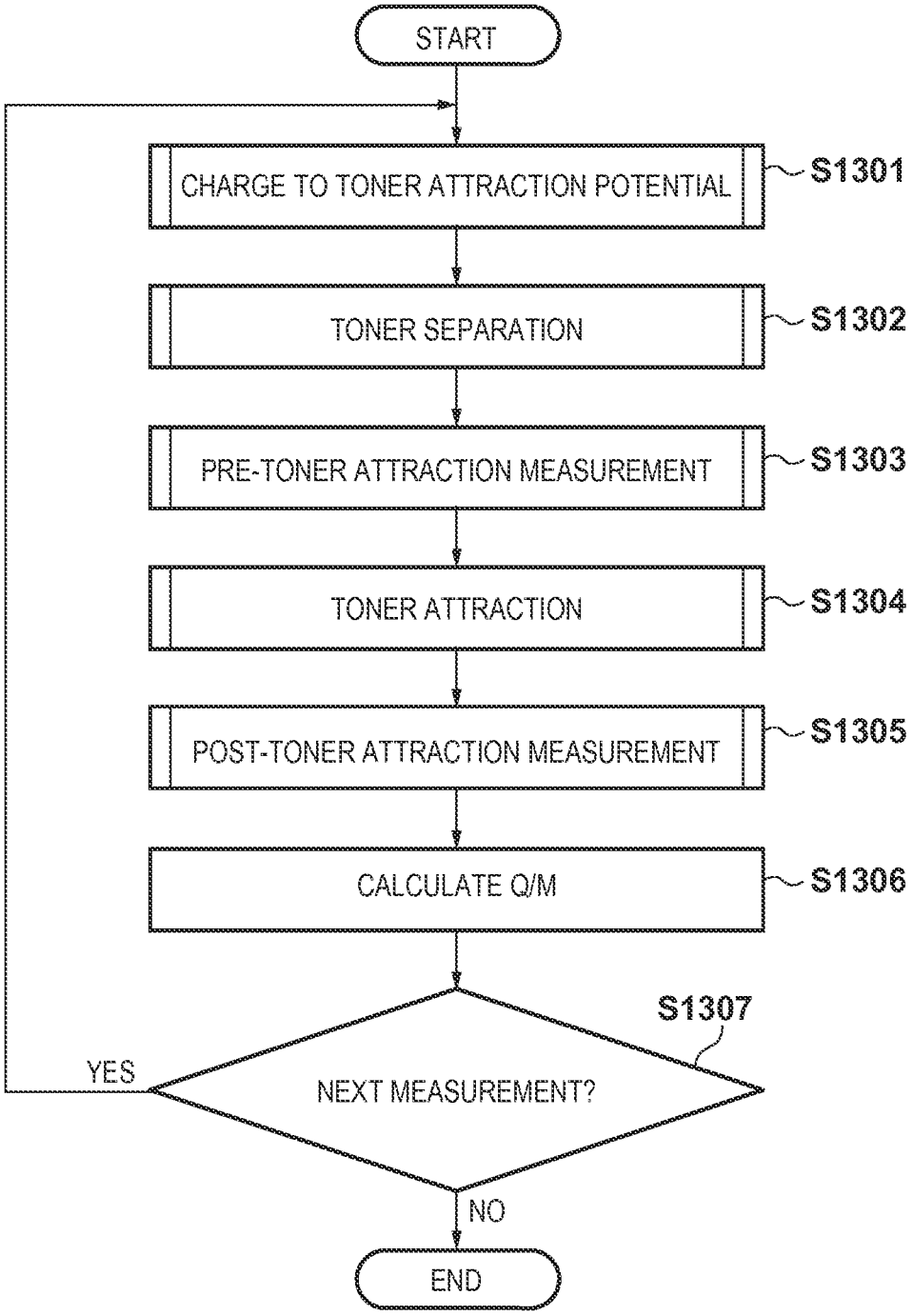
FIG. 10 is a flowchart illustrating a toner charge amount measurement sequence according to the first embodiment.
Figure 13:
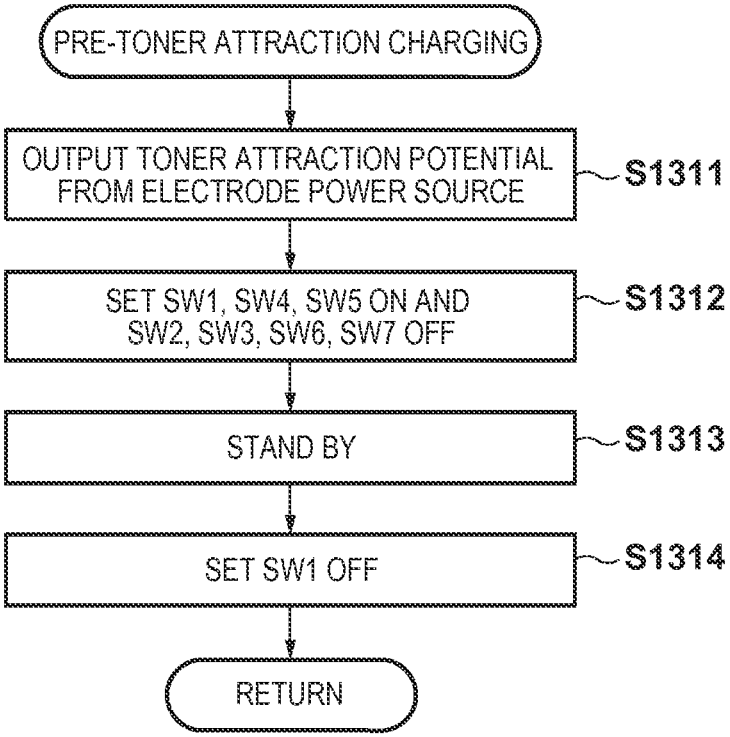
FIG. 13 is a flowchart illustrating a toner attracting potential charging sequence according to the first embodiment.

FIG. 13 illustrates in detail a flow for charging the toner attracting potential carried out in S1301 of FIG. 10.

In S1311, the Q/M measuring unit 1101 outputs a toner attracting potential +150 V from the electrode power source 1104 in order to charge the Q measurement capacitor C1 to the toner attracting potential.

In S1312, the Q/M measuring unit 1101 sets the switches SW1, SW4, and SW5 to on and sets the switches SW2, SW3, SW6, and SW7 to off. The electrode power source 1104 and the Q measurement capacitor C1 are connected by setting the switches SW1 and SW4 to on. As a result, the Q measurement capacitor C1 begins to be charged to the toner attracting potential +150 V. Here, because the resistance R1 is present between the toner attracting surface electrode 121 and the electrode power source 1104, the potential of the toner attracting surface electrode 121 (the solid line 901) is equal to the potential of the Q measurement capacitor C1 (the dot-dash line 903). For example, if the potential of the Q measurement capacitor C1 is −200 V, the potential of the toner attracting surface electrode 121 is also −200 V. At this time, the SW5 is also turned on, and the toner non-attracting surface electrode 122 and the toner attracting surface electrode 121 have the same potential as a result.

In S1313, the Q/M measuring unit 1101 stands by for a set charging period until the potential difference between both ends of the Q measurement capacitor C1 reach +150 V. As indicated by times t1 to t6 in FIG. 12, the +150 V toner attracting potential output from the electrode power source 1104 is supplied through the resistance R1, the switch SW4, and the switch SW1, and thus the potential −200 V remaining in the Q measurement capacitor C1 is charged to the toner attracting potential +150 V. The charging period is determined by the potential remaining in the Q measurement capacitor C1 and a time constant of the Q measurement capacitor C1 and the resistance R1.

In the aforementioned charging period, the toner attracting potential +150 V is also applied to the toner attracting surface electrode 121. At times t2 to t3 and t4 to t5, the potential +150 V of the toner attracting surface electrode 121 is +1350 V higher than the potential −1200 V of the developing sleeve 111, and thus the toner is attracted to the toner attracting surface electrode 121. However, the toner is removed in the next sequence, and thus there is no problem even if the toner is attracted to the toner attracting surface electrode 121 at this stage. Furthermore, the charge of the toner attracted during the charging period is discharged through the electrode power source 1104 connected thereto.

Note that a method where the Q/M measuring unit 1101 stands by for a predetermined amount of time, a method where the potential difference between both ends of the Q measurement capacitor C1 is measured, and so on may be used as the method for standing by in S1313.

In S1314, the Q/M measuring unit 1101 sets the switch SW1 to off. In other words, after charging the Q measurement capacitor C1 to the toner attracting potential, the switch SW1 that was on is set to off, and the toner attracting potential +150 V to which the Q measurement capacitor C1 has been charged is held.

Through this, the toner attracting potential charging sequence in FIG. 10 (S1301) is completed.

Toner Separation (S1302)

Figure 14:
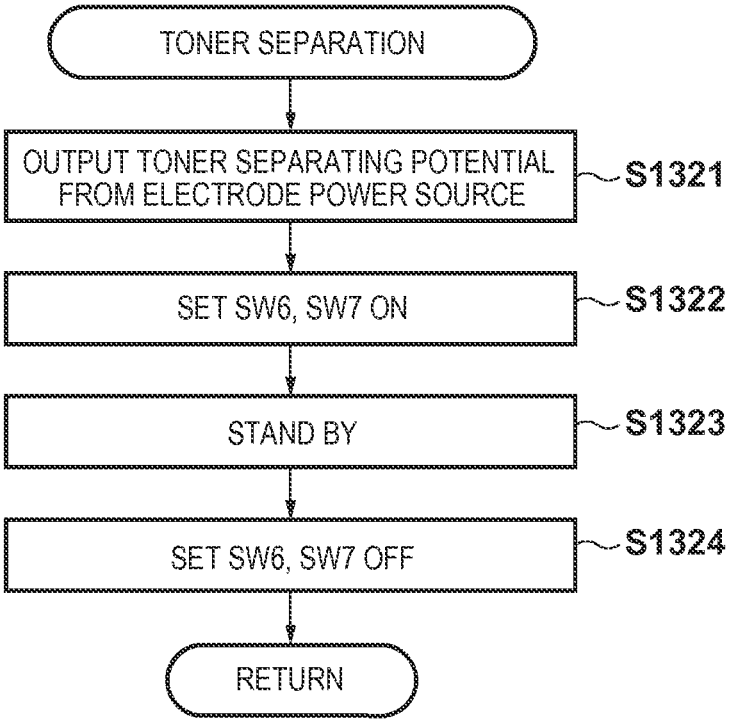
FIG. 14 is a flowchart illustrating a toner separation sequence according to the first embodiment.

After the charging has been completed, the Q/M measuring unit 1101 separates the toner attracted to the toner attracting surface electrode 121. FIG. 14 illustrates the details of a flow for toner separation indicated in S1302 of FIG. 10.

In S1321, the Q/M measuring unit 1101 applies the toner separating potential to the toner attracting surface electrode 121 using the electrode power source 1104. The Q/M measuring unit 1101 outputs −1050 V, for example, from the electrode power source 1104 as the toner separating potential for separating the toner adhering to the toner attracting surface electrode 121. Because the switch SW4 and the switch SW5 are already on, when the toner separating potential −1050 V is applied to the toner attracting surface electrode 121 and the toner non-attracting surface electrode 122, the toner separates from the toner attracting surface electrode 121.

In S1322, the Q/M measuring unit 1101 sets the switches SW4, SW5, SW6, and SW7 to on and sets the switches SW1, SW2, and SW3 to off. Next, the Q/M measuring unit 1101 electrically connects the excessive voltage protection capacitor Cv and the resistances R1 and R2 by setting the switch SW6 and the switch SW7 to on, and the potential in the excessive voltage protection capacitor Cv is discharged to 0 V.

In S1323, the Q/M measuring unit 1101 stands by for a set discharge period until the potential of the excessive voltage protection capacitor Cv reaches 0 V. At times t7 to t8 and t9 to t10 in FIG. 12, the potential of the toner attracting surface electrode 121 (the solid line 901) is 1350 V lower than the potential of the developing sleeve 111 (the dotted line 902). Accordingly, the potential of the developing sleeve 111 is higher than the potential of the toner attracting surface electrode 121, and thus the toner attracted to the toner attracting surface electrode 121 moves to the developing sleeve 111. Through this, the toner attracted to the toner attracting surface electrode 121 separates therefrom.

Meanwhile, the potential +150 V remaining in the excessive voltage protection capacitor Cv is discharged to 0 V. In this manner, the Q/M measuring unit 1101 stands by until the toner on the toner attracting surface electrode 121 has completely separated. The method for the standby in S1323 may be standing by for an amount of time determined in advance through experimentation.

In S1324, the Q/M measuring unit 1101 sets the switches SW6 and SW7 to off. After the toner on the toner attracting surface electrode 121 has been separated, the Q/M measuring unit 1101 sets the switches SW6 and SW7 from on to off, and cuts the electrical connection of the excessive voltage protection capacitor Cv.

Note that the switch SW1 between the Q measuring circuit 1102 and the toner attracting surface electrode 121 is continually off while the toner separation sequence is being executed, and thus the potential of the Q measurement capacitor C1 indicated by the dot-dash line 903 is held at the toner attracting potential +150 V.

Pre-Toner Attraction Measurement (S1303)

Figure 15:
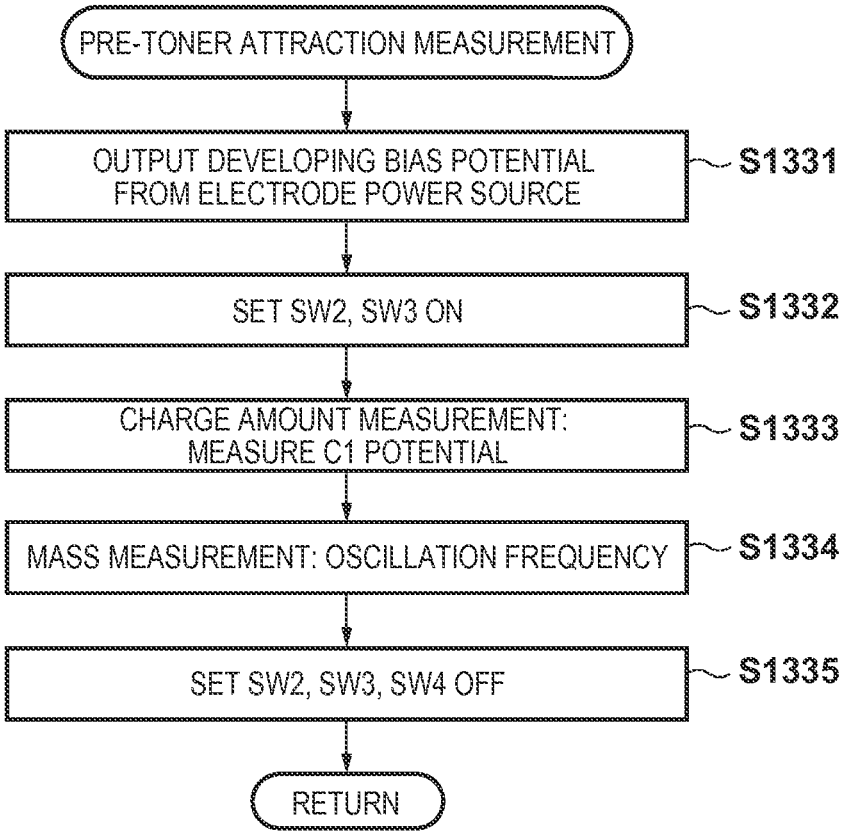
FIG. 15 is a flowchart illustrating a pre-toner attraction measurement sequence according to the first embodiment.
Figure 16:
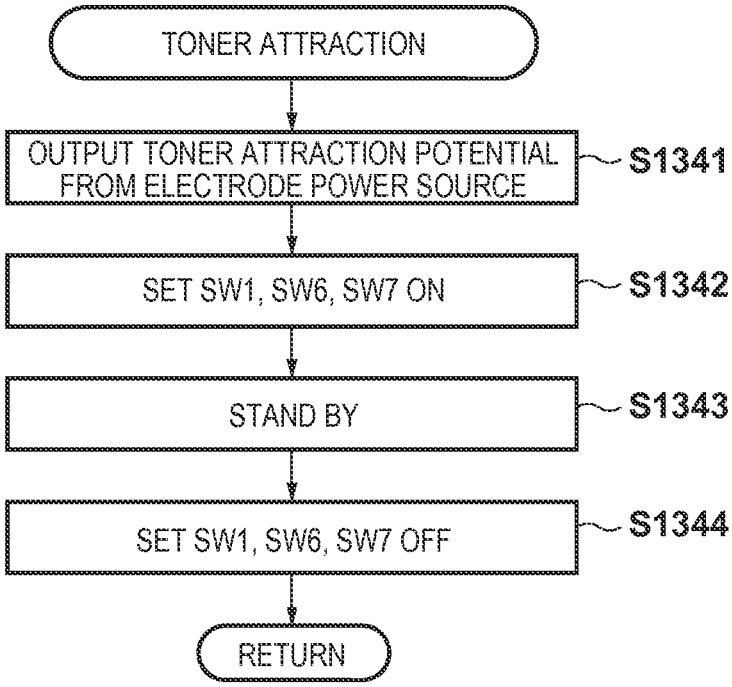
FIG. 16 is a flowchart illustrating a toner attracting sequence according to the first embodiment.

Details of the pre-toner attraction measurement sequence (S1303) indicated in FIG. 10 will be given based on the flowchart in FIG. 15. Here, the potential difference V1 between both ends of the Q measurement capacitor C1 before the toner attraction and the oscillation frequency f1 before the toner attraction are measured.

In S1331, the Q/M measuring unit 1101 causes the developing bias to be output from the electrode power source 1104. In order to ensure that the toner is not attracted to the toner attracting surface electrode 121 while measuring the oscillation frequency f1, the Q/M measuring unit 1101 applies the developing bias potential and sets the toner attracting surface electrode 121 and the developing sleeve 111 to the same potential.

In accordance with the same output waveform as the developing bias potential applied to the developing sleeve 111 from the electrode power source 1104, the Q/M measuring unit 1101 controls the voltage applied to the toner attracting surface electrode 121 in synchronization with the developing bias potential. Note that there may be a slight potential difference as long as the voltage applied to the toner attracting surface electrode 121 is within a range at which the toner is not attracted to the developing sleeve 111 from the toner attracting surface electrode 121. FIG. 12 illustrates an example in which the electrode potential generating unit 1236 controls the voltage applied to the toner attracting surface electrode 121 so as to be 20 V higher than the voltage applied to the developing sleeve 111. Note that the potential of the toner attracting surface electrode 121 (the solid line 901) indicated in FIG. 12 has a positive-side potential +320 V and a negative-side potential −1180 V.

In S1332, the Q/M measuring unit 1101 sets the switches SW2 and SW3 to on. When the switch SW2 and the switch SW3 are set to on and the oscillation circuit 1233 and the charge amount measurement unit 108 are connected, the potential of the developing sleeve 111 oscillates at a high frequency by several V, as indicated by the dotted line 902. If the developing bias potential is applied to the oscillation circuit 1233 at this time, elements and so on used in the oscillation circuit 1233 will be damaged. The coupling capacitors C2 and C3 prevent this from occurring. The coupling capacitors C2 and C3 have a quality of allowing high-frequency signals to pass through but not allowing DC or low-frequency signals to pass through. Assuming that the oscillation frequency of the oscillation circuit 1233 is 5 MHz, the cycle thereof is 0.2 μs. The time of the change of the developing bias potential is set to a time that is longer than this cycle, such as 2 μs. By adjusting the capacitance values of the coupling capacitors C2 and C3, a high-potential developing bias potential can be prevented from being applied to the oscillation circuit 1233. In the present embodiment, the capacitance values of the coupling capacitors C2 and C3 are adjusted so that, for example, a 5 MHz oscillation signal passes through but fluctuations having change times of 2 μsec are blocked.

In S1333, from time t12 to t13, the Q/M measuring unit 1101 uses the electrometer 1231 to measure the toner attracting potential +150 V charged in the Q measurement capacitor C1. This is done in order to measure the potential of the toner attracting surface electrode 121 at a high level of precision by avoiding the influence of electromagnetic waves emitted when the potential of the toner attracting surface electrode 121 (the solid line 901) changes. The Q/M measuring unit 1101 records the potential difference between both ends of the Q measurement capacitor C1 before toner attraction in the charge amount calculation unit 1232 as a pre-toner attraction potential V1.

Note that because the switch SW1 is off, the Q measuring circuit 1102 is isolated from the other circuits. Furthermore, to shorten the measurement time, the configuration may be such that the measurement of the pre-toner attraction potential V1 is executed in parallel with step S1334, mentioned below.

In S1334, from time t12 to t13, the Q/M measuring unit 1101 measures the oscillation frequency f1 of the oscillation circuit 1233 using the frequency measuring unit 1234. This is done in order to measure the oscillation frequency at a high level of precision by avoiding the influence of fine potential changes under several V, which cannot be completely removed by the coupling capacitors C2 and C3. The Q/M measuring unit 1101 records the measured oscillation frequency in the mass calculation unit 1235 as a pre-toner attraction frequency f1.

In S1335, the Q/M measuring unit 1101 sets the switches SW2, SW3, and SW4 to off. Through this, the Q/M measuring unit 1101 ends the reference value measurement sequence.

Note that the potential between both ends of the Q measurement capacitor C1 before toner attraction may be measured by the electrometer 1231 a plurality of times and an average value of the plurality of measurement results may be taken as the pre-toner attraction potential V1. Furthermore, the oscillation frequency of the oscillation circuit 1233 before toner attraction may be measured a plurality of times and an average value of the plurality of measurement results may be taken as the pre-toner attraction frequency f1. Although this configuration does increase the measurement time, measurement error can also be reduced, which in turn improves the accuracy of the measured values.

Toner Attraction (S1304)

The Q/M measuring unit 1101 causes the toner attracting surface electrode 121 to attract the toner after the pre-toner attraction potential V1 and the pre-toner attraction frequency f1 have been measured. Details of the toner attracting sequence in S1304 of FIG. 10 will be given based on the flowchart in FIG. 16.

In S1341, the Q/M measuring unit 1101 outputs a toner attraction potential using the electrode power source 1104. Here, the Q/M measuring unit 1101 controls the voltage applied to the toner attracting surface electrode 121 by the electrode power source 1104 so that the potential of the toner attracting surface electrode 121 reaches a toner attracting potential +150 V. In the case where the toner attracting surface electrode 121 is caused to attract the toner using the toner attracting potential charged in the Q measurement capacitor C1, the Q/M measuring unit 1101 also controls the toner non-attracting surface electrode 122 to take on the same potential as the toner attracting surface electrode 121. The switch SW5 is on, and thus the toner attracting potential +150 V is also applied to the toner non-attracting surface electrode 122.

In S1342, the Q/M measuring unit 1101 sets the switches SW1, SW6, and SW7 to on. The toner attracting surface electrode 121 and the Q measurement capacitor C1 are connected as a result of the switch SW1 being set to on, and the toner attracting potential +150 V with which the Q measurement capacitor C1 is charged is applied to the toner attracting surface electrode 121. In addition, the excessive voltage protection capacitor Cv is connected between the toner attracting surface electrode 121 and the toner non-attracting surface electrode 122 as a result of the switch SW6 and the switch SW7 being set to on, and thus an excessive voltage is prevented from being applied to the quartz chip 127, the oscillation circuit 1233, and so on.

In S1343, the Q/M measuring unit 1101 stands by for a set period. At time t14 to t15 in FIG. 12, the potential +150 V of the toner attracting surface electrode 121 is 600 V higher than the potential −450 V of the developing sleeve 111, and thus some of the toner on the developing sleeve 111 is attracted to the toner attracting surface electrode 121. The potential of the toner attracting surface electrode 121 (the solid line 901) decreases due to the negative potential of the toner attracted to the toner attracting surface electrode 121. The potential of the toner attracting surface electrode 121 drops to +100 V at time t15.

At time t15 to t16, the potential +300 V of the developing sleeve 111 is 200 V higher than the potential +100 V of the toner attracting surface electrode 121, and thus no toner is attracted to the toner attracting surface electrode 121. Accordingly, the potential of the toner attracting surface electrode 121 remains at +100 V. In t16 to t17, the potential +100 V of the toner attracting surface electrode 121 is 1300 V higher than the potential −1200 V of the developing sleeve 111, and thus some of the toner on the developing sleeve 111 is attracted to the toner attracting surface electrode 121. At time t17, the potential of the toner attracting surface electrode 121 (the solid line 901) decreases to −50 V due to the negative potential of the toner attracted to the toner attracting surface electrode 121.

At time t17 to t18, the potential +300 V of the developing sleeve 111 is 350 V higher than the potential −50 V of the toner attracting surface electrode 121, and thus no toner is attracted to the toner attracting surface electrode 121. At time t18 to t19, the potential −50 V of the toner attracting surface electrode 121 is 1150 V higher than the potential −1200 V of the developing sleeve 111, and thus some of the toner on the developing sleeve 111 is attracted to the toner attracting surface electrode 121. At time t19, the potential of the toner attracting surface electrode 121 (the solid line 901) decreases to −200 V due to the negative potential of the toner attracted to the toner attracting surface electrode 121. At time t19 to t20, the potential −200 V of the toner attracting surface electrode 121 is 200 V higher than the potential −450 V of the developing sleeve 111, and thus a minute amount of the toner on the developing sleeve 111 is attracted to the toner attracting surface electrode 121. Here, because only a minute amount of toner is attracted to the toner attracting surface electrode 121, the potential thereof remains at −200 V.

In the case of a configuration where the excessive voltage protection capacitor Cv is not provided, the potential of the toner attracting surface electrode 121 drops by approximately 1000 V due to the negative charge of the toner attracted to the toner attracting surface electrode 121. In other words, the potential of the toner attracting surface electrode 121 drops from +150 V to −850 V. However, due to the excessive voltage protection capacitor Cv being connected, the potential of the toner attracting surface electrode 121 drops only up to −200 V. This example describes the potential dropping 350 V, from +150 V to −200 V, to simplify the descriptions. Note that in this case, there is a potential difference of 350 V between the toner attracting surface electrode 121 and the toner non-attracting surface electrode 122, and thus the capacitance value of the excessive voltage protection capacitor Cv is set so that the actual potential difference is approximately several V.

From time t14 to t20, the Q/M measuring unit 1101 stands by until the toner finishes adhering to the toner attracting surface electrode 121. Here, the method for the standby may be standing by for a predetermined amount of time. Note that the charge of the toner attracted to the toner attracting surface electrode 121 is stored in two capacitors, namely the Q measurement capacitor C1 and the excessive voltage protection capacitor Cv. Accordingly, the amount of electric charge stored in the Q measurement capacitor C1 is C1/(C1+Cv).

In S1344, the Q/M measuring unit 1101 sets the switches SW1, SW6, and SW7 to off. After the attraction of the toner to the toner attracting surface electrode 121 is complete, the Q/M measuring unit 1101 sets the switches SW1, SW6, and SW7 that were on to off, and stops the attraction of toner. At this time, the Q measurement capacitor C1 is disconnected from toner attracting surface electrode 121, and thus the Q measurement capacitor C1 holds the potential that has changed due to the toner attraction.

Post-toner Attraction Measurement (S1305)

After the toner attraction is complete, the Q/M measuring unit 1101 measures the potential of the Q measurement capacitor C1 and the oscillation frequency of the charge amount measurement unit 108 after the toner attraction. Here, the post-toner attraction potential difference between both ends of the Q measurement capacitor C1 is taken as a post-toner attraction potential V2, and the post-toner attraction oscillation frequency f2 is taken as a post-toner attraction frequency f2. The Q/M measuring unit 1101 calculates the toner charge amount Q/M based on a difference between the pre-toner attraction potential V1 and the post-toner attraction potential V2 and a difference between the pre-toner attraction frequency f1 and the post-toner attraction frequency f2. Details of the post-toner attraction measurement sequence in S1305 of FIG. 10 will be given based on the flowchart in FIG. 17.

The difference from the aforementioned pre-toner attraction measurement sequence (S1331 to S1335) is that the switch SW4, which has been set to off for the toner attraction, is set to on in S1346. Furthermore, in S1349, the switch SW5 is set to off. The state of the switches during measurement is the same as in the aforementioned pre-toner attraction measurement sequence, and thus descriptions thereof will be omitted here. Note that the measurement process is carried out from time t21 to t22.

Calculation of Amount of Electric Charge Q

The charge amount calculation unit 1232 calculates the amount of electric charge Q from the recorded pre-toner attraction potential V1 and the measured post-toner attraction potential V2. When the capacitance value of the Q measurement capacitor C1 is represented by C1 and the capacitance of the excessive voltage protection capacitor Cv is represented by Cv, an amount of electric charge Q1 stored in the Q measurement capacitor C1 can be calculated as C1*(V1−V2). Furthermore, because the potential of the excessive voltage protection capacitor Cv is the same as the amount of potential change in C1, or in other words, is the same as (V1−V2), a stored amount of electric charge Qv can be calculated as Cv*(V1−V2).

The amount of electric charge Q of the attracted toner is a sum of the amounts of electric charge stored in the two capacitors, and can thus be calculated through Formula (3).

$$Q=Q1+Qv=(C1+Cv)*(V1-V2) \tag{3}$$

Calculation of Mass M

The mass calculation unit 1235 calculates the mass M from the recorded pre-toner attraction frequency f1 and the measured post-toner attraction frequency f2. When the surface area of the toner attracting surface electrode is represented by A, the shearing stress of the quartz is represented by μ, and the relative density of the quartz is represented by p, the mass M can be calculated through Formula (4), which is a modification of Formula (I).

$$M=-\frac{(f_2-f_1)\times A\sqrt{\mu-p}}{2(f_1)^2} \tag{4}$$

Calculation of Q/M (S1306)

The Q/M calculation unit 1106 calculates the toner charge amount Q/M using the amount of electric charge Q measured by the Q measuring circuit 1102 and the mass M measured by the M measuring circuit 1103. This calculation is started immediately after the amount of electric charge Q and the mass M have been calculated, following t22 in FIG. 12.

A characteristic of the measurement in the present embodiment is that the amount of toner does not increase or decrease during the measurement, and the amount of electric charge Q and the mass M are measured from the same toner. Accordingly, the toner charge amount Q/M can be calculated through Formula 5.

$$Q/M=(\text{measured } Q)/(\text{measured } M) \tag{5}$$

The charge amount Q/M is measured through the sequence described above. Note that in the case where the toner charge amount Q/M is to be measured again, the toner adhering to the toner attracting surface electrode 121 is separated therefrom, the charges stored in the Q measurement capacitor C1 and the excessive voltage protection capacitor Cv are discharged, and so on. However, the toner separation is carried out before the pre-toner attraction measurement, and thus need not be carried out after the measurement. Furthermore, when the charging sequence (S1301) is executed, the potential of the Q measurement capacitor C1 is controlled to take on the toner attracting potential, and thus it is not necessary to discharge the Q measurement capacitor C1 after the measurement. The charge remaining in the excessive voltage protection capacitor Cv is also discharged during the toner separation sequence, and thus post-measurement discharge is not necessary (S1302).

LUT Correction

The CPU 606 determines whether or not the measured toner charge amount Q/M is within a predetermined range of numerical values stored in advance. If the toner charge amount Q/M is not within the predetermined range of numerical values, the CPU 606 corrects the LUT 601 via the LUT correction unit 602, based on the charge amount Q/M. These LUT correction process will be described hereinafter.

Figure 18A:
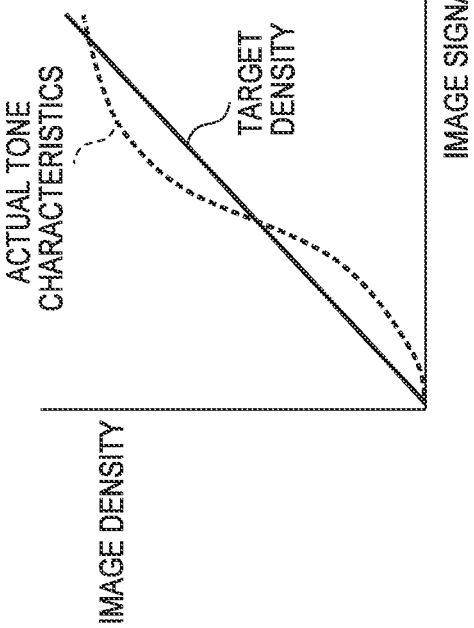
FIGS. 18A and 18B are diagrams illustrating a γLUT that indicates a relationship between an image signal and an image density.
Figure 18B:
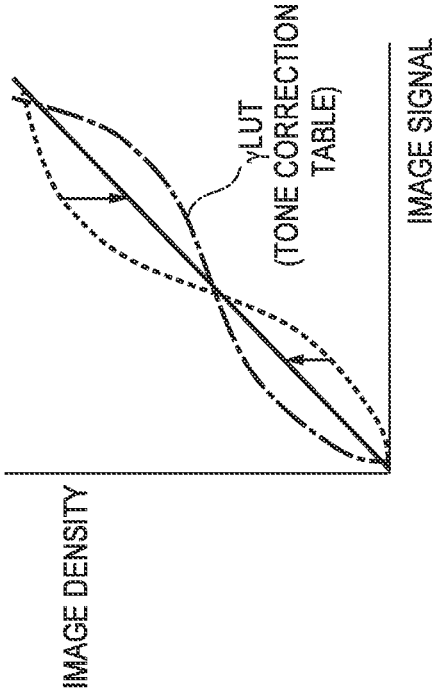

First, a γLUT will be described. The image forming apparatus has tone characteristics indicated by "actual tone characteristics" shown in FIG. 18A, for example. FIGS. 18A and 18B are graphs illustrating a relationship between an image signal and an image density. Here, the vertical axis represents the image density and the horizontal axis represents the image signal.

Normally, for the tone characteristics of the image forming apparatus, it is suitable for the density, brightness, or the like of an image output in response to the input image signal to be linear. However, the unique tone characteristics of an image forming apparatus are not necessarily linear. Accordingly, to obtain the desired tone characteristics, the controller 1107 performs an inverse transform on the "actual tone characteristics" in FIG. 18A, and creates the "γLUT", which is a tone correction table expressing a correspondence relationship between the image signal and the image density (for example, FIG. 18B). Using the γLUT makes it possible to convert the actual tone characteristics into a target density.

The γLUT is created through the following process. An electrostatic latent image of a patch image having a plurality of tones set in advance is created, developed, and the patch image having a plurality of tones is formed on the photosensitive drum 101 as a result. Then, after the development process, an optical sensor 607 disposed in a position facing the photosensitive drum 101 is used to measure the density of the patch image that has been formed. The γLUT is created from the image data of the patch image and the tone characteristics obtained from the measured patch image density. It is necessary for the γLUT to output a patch image having a plurality of tones, and it is thus difficult to create the γLUT in a short amount of time. Skew may arise in the γLUT during printing due to the effects of environmental fluctuations, material variations, and so on, and there are thus cases where the desired output image density cannot be obtained. Accordingly, in the present embodiment, tone correction control is carried out for correcting the γLUT during the image forming process.

In the present embodiment, a reference γLUT is first created through the aforementioned method. The generated γLUT is stored in a storage medium such as a non-volatile memory. Alternatively, a γLUT held in advance in a memory (for example, the ROM 605 provided in the controller 1107) may be used as the reference γLUT. The γLUT is created, for example, immediately after the image forming apparatus is started up, after a set number of prints have been executed, or in cases where it is possible that the tone has changed.

Figure 19:
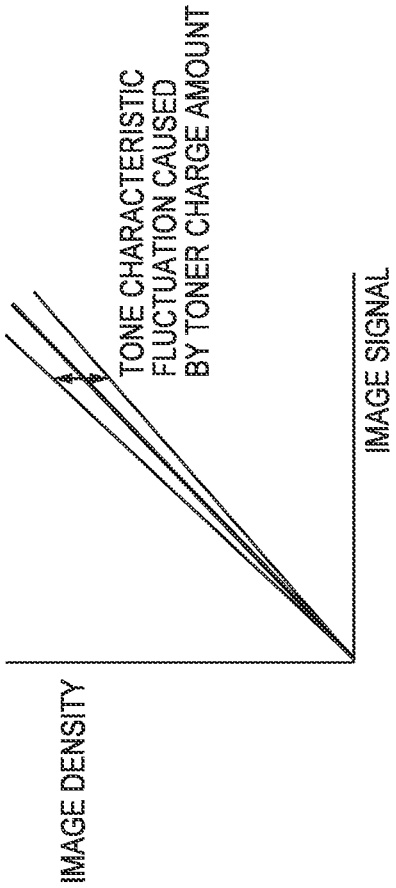
FIG. 19 is a diagram illustrating tone characteristics occurring when a toner charge amount is changed.

Furthermore, FIG. 19 is a schematic diagram illustrating tone characteristics fluctuations caused by the toner charge amount. Here, the vertical axis represents the image density and the horizontal axis represents the image signal. The image density relative to the image signal behaves as shown in FIG. 19 as a result of changes in the toner charge amount. Accordingly, an amount equivalent to a fluctuation amount ΔQ/M of the toner charge amount is corrected in the γLUT. For example, the γLUT is corrected by multiplying the γLUT by a toner charge amount correction coefficient k. The correction coefficient k can be found through the following Formula (6), for example.

$$k=(Q/M)/(Q/M\mathrm{ref}) \tag{6}$$

γLUT Correction Process

Figure 20:
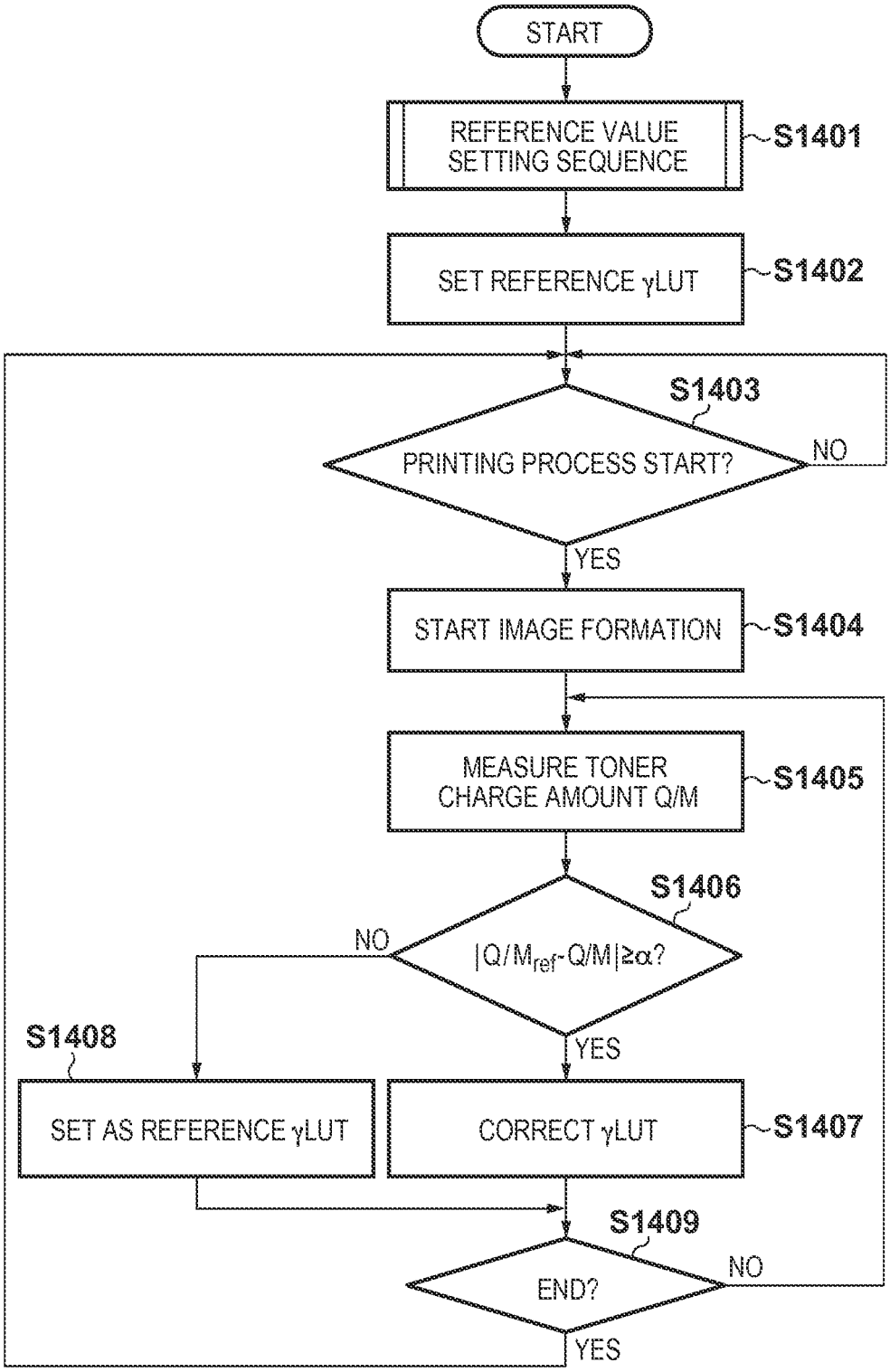
FIG. 20 is a flowchart for correcting an LUT.

Details of the γLUT correction process will be described using FIG. 20. This processing flow is executed by the LUT correction unit 602.

In S1401, the LUT correction unit 602 carries out a process for setting a reference value. Details of this process will be given later using FIG. 21. In S1402, the LUT correction unit 602 sets the γLUT determined in S1401 as the reference γLUT. In S1403, the LUT correction unit 602 determines whether or not a printing process has been started. In the case where the printing process has been started (YES in S1403), the process advances to S1404, whereas in the case where the printing process has not been started (NO in S1403), the apparatus stands by until the process is started.

In S1404, the LUT correction unit 602 starts image formation. In S1405, the LUT correction unit 602 measures the toner charge amount Q/M through the aforementioned method while image forming is being carried out. In S1406, the LUT correction unit 602 determines whether or not a difference between Q/Mref, serving as the reference value of the toner charge amount, and Q/M measured in S1405 is greater than or equal to a threshold α. Here, α may be set as appropriate in accordance with fluctuations in the relationship between the image density and the image signal caused by fluctuations in the tone characteristics from the toner charge amount, as indicated in FIG. 19. In the case where the difference is greater than or equal to the threshold α (YES in S1406), the process advances to S1407, whereas in the case where the difference is less than the threshold α (NO in S1406), the process advances to S1408.

In S1407, the LUT correction unit 602 corrects the γLUT that is currently set. Here, as described above, the γLUT is corrected using the correction coefficient k found through Formula (6). The process then advances to S1409. On the other hand, in S1408, the LUT correction unit 602 does not correct the reference γLUT, and the process advances to S1409. In S1409, the LUT correction unit 602 determines whether or not one page's worth of image formation has finished. The process returns to S1403 in the case where one page's worth of image formation has finished in S1409 (YES in S1409), where the apparatus stands by until the next printing process is started. On the other hand, the process returns to S1405 in the case where one page's worth of image formation has not finished in S1409 (NO in S1409), where the toner charge amount Q/M is measured and the correction of the γLUT based on fluctuations therein is repeated.

Reference Value Setting Sequence

Figure 21:
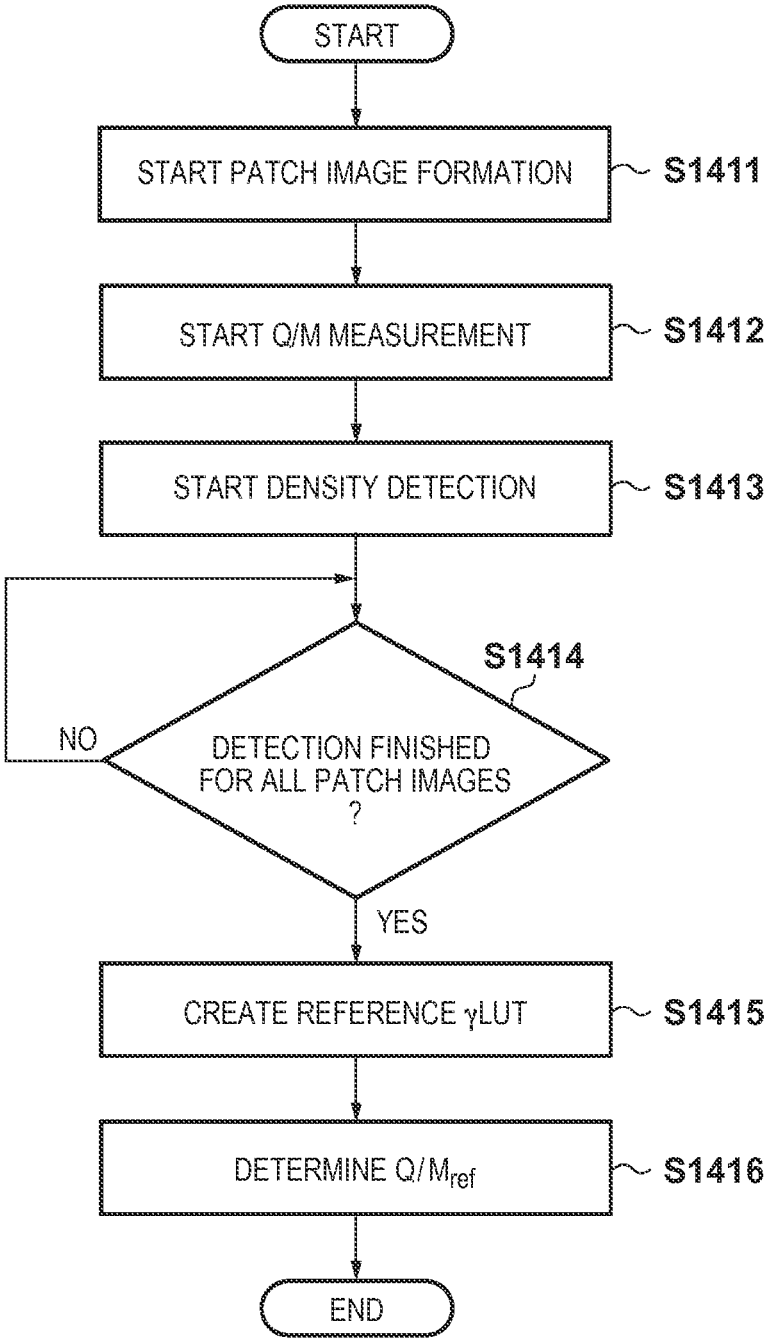
FIG. 21 is a flowchart for setting a reference value.

Details of the flow of the reference value setting sequence of S1401 in FIG. 20 will be described using FIG. 21.

In S1411, the LUT correction unit 602 starts forming the patch image on the photosensitive drum 101 based on a predetermined image signal. For example, it is assumed that in the case where the image forming apparatus is configured to form images of 256 tones, a plurality of patch images are formed every 16 levels, from an image signal corresponding to a tone level 16 to an image signal corresponding to a tone level 256. In S1412, the LUT correction unit 602 starts measuring the toner charge amount while forming the patch image. In S1413, the LUT correction unit 602 starts detecting the density of the patch image using the optical sensor 607. In S1414, the LUT correction unit 602 determines whether or not the density has been detected for all the patch images that have been formed. The process advances to S1415 in the case where the density has been detected for all the patch images (YES in S1414), whereas in the case where the density has not been detected for all the patch images (NO in S1414), the apparatus stands by until the patch detection is complete.

In S1415, the LUT correction unit 602 creates the γLUT based on the detected patch density and the output signal occurring at that time, and sets the created γLUT as the reference γLUT. In S1416, the LUT correction unit 602 sets the toner charge amount Q/Mref, that serves as a reference, based on the toner charge amount measured when forming the patch image. The reference value setting sequence then ends.

According to the present embodiment, an excessive voltage on the oscillator, the oscillation circuit, and so on can be suppressed, and thus the oscillator, the oscillation circuit, and so on can be prevented from being damaged, electrodes can be prevented from separating, and so on. Specifically, even in the case where the configuration is such that a QCM sensor having low capacitance properties is used and toner having a charge is caused to be attracted to an electrode thereof, the potential applied to the QCM sensor can be weakened by a high-capacitance capacitor disposed in parallel thereto. As a result, damage to the sensor, separation of electrodes, and so on due to high potentials can be prevented.

Second Embodiment

Although the first embodiment describes an example in which two capacitors, namely the Q measurement capacitor C1 and the excessive voltage protection capacitor Cv, are used, the present embodiment describes a case where the excessive voltage protection and measurement of the amount of electric charge Q are carried out using only the excessive voltage protection capacitor Cv.

Overview of Q/M Measurement

Figure 22:
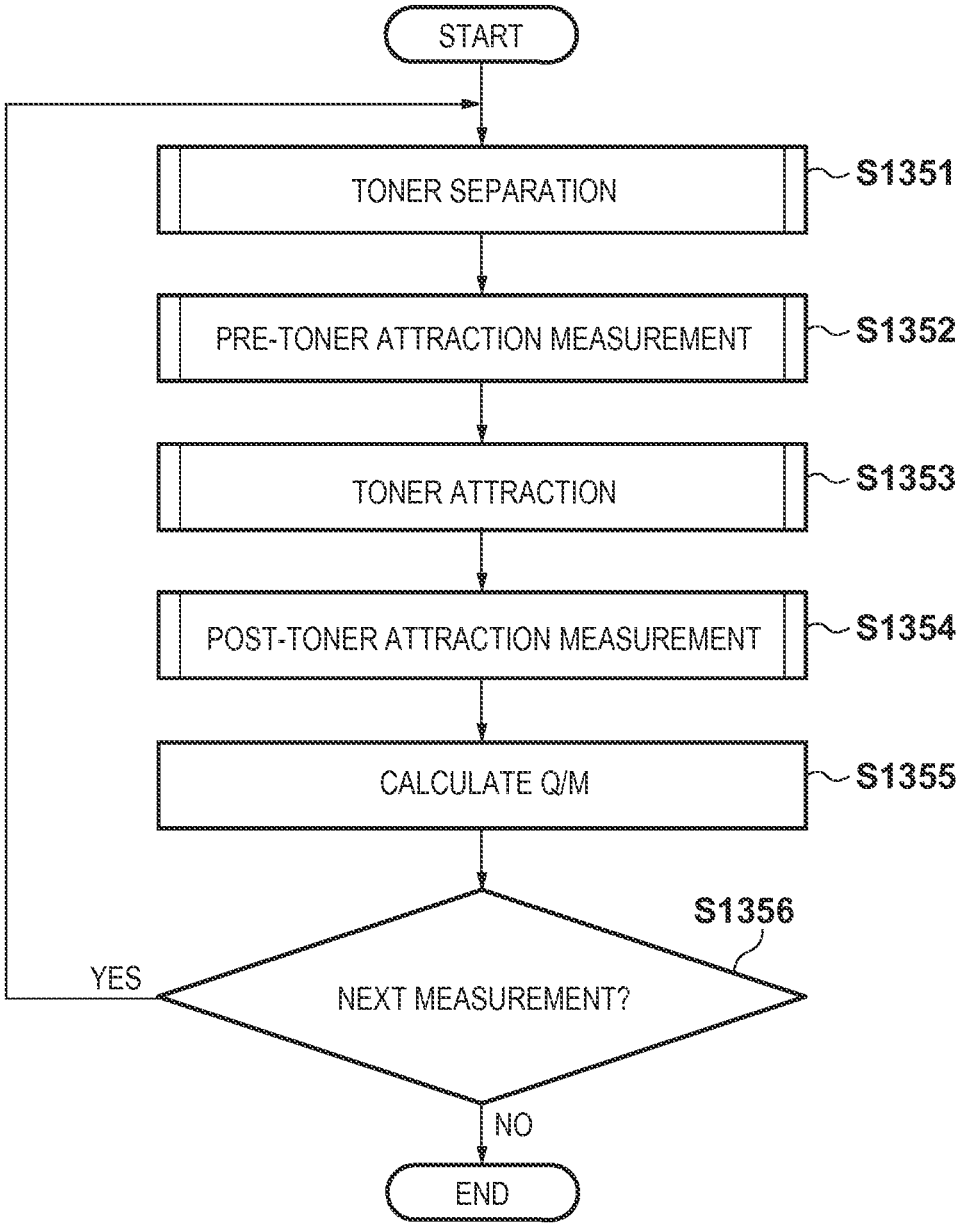
FIG. 22 is a flowchart illustrating a toner charge amount measurement sequence according to a second embodiment.

FIG. 22 illustrates a general flow of Q/M measurement according to the present embodiment. The difference from the general Q/M measurement flow in the first embodiment is that the flow starts from toner separation, without charging the toner attracting potential. With respect to the flowchart in FIG. 22, illustrating an overview of the Q/M measurement according to the second embodiment, only sequences that differ from those in the first embodiment will be described.

In S1352, the Q/M measuring unit 1101 carries out pre-toner attraction measurement. Unlike the first embodiment, the excessive voltage protection capacitor Cv that measures the amount of electric charge Q is not charged, and thus the pre-toner attraction potential V1 is 0 V. Accordingly, the Q/M measuring unit 1101 measures only the pre-toner attraction frequency f1.

In S1353, the Q/M measuring unit 1101 carries out toner attraction. The difference from the first embodiment is that the toner attraction potential is applied from the electrode power source 1104 directly to the toner non-attracting surface electrode 122 only, and nothing is applied to the toner attracting surface electrode 121.

Detailed Description of Q/M Measurement

Figure 23:
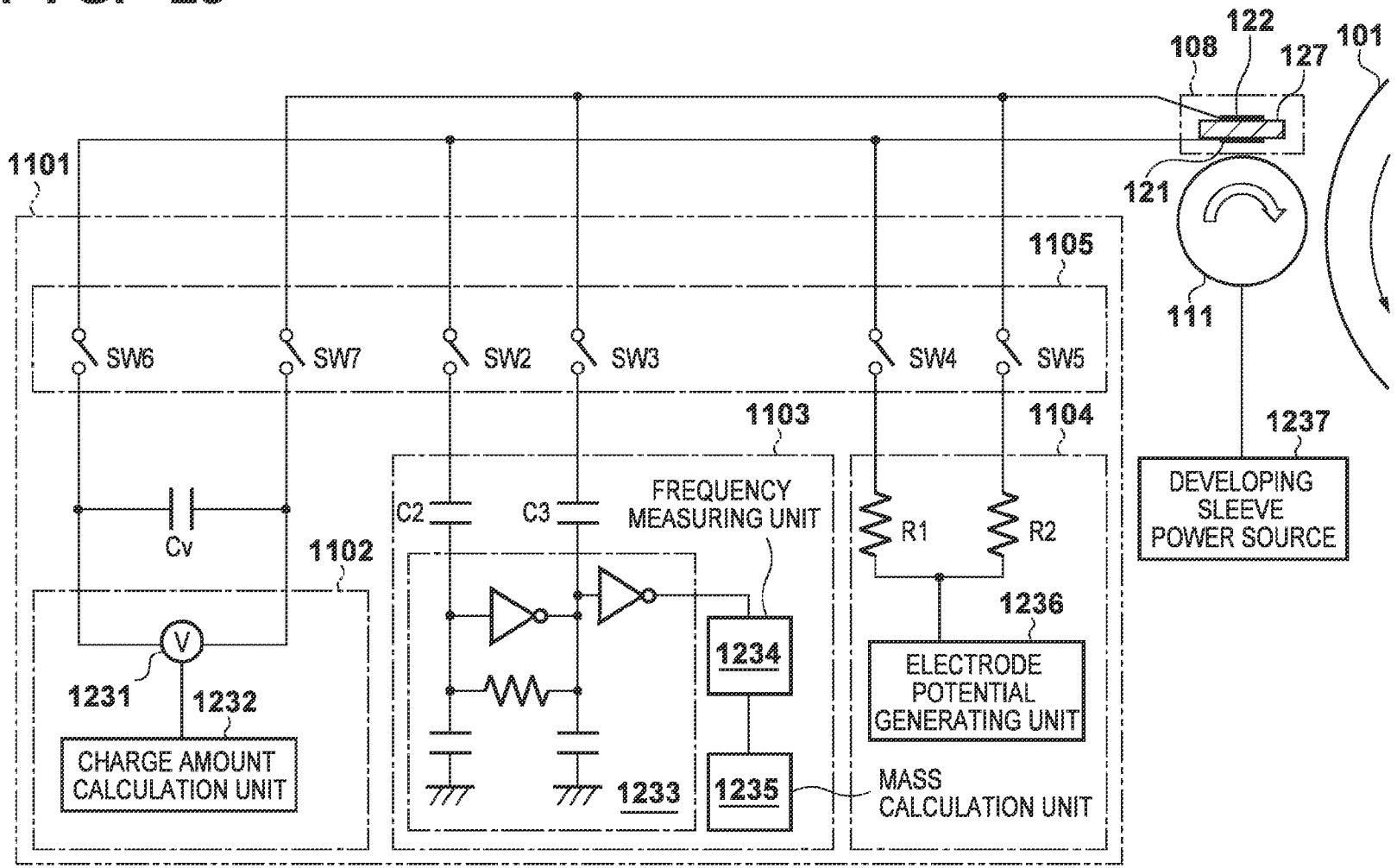
FIG. 23 is a circuit diagram illustrating a Q/M measuring unit according to the second embodiment.
Figure 24:
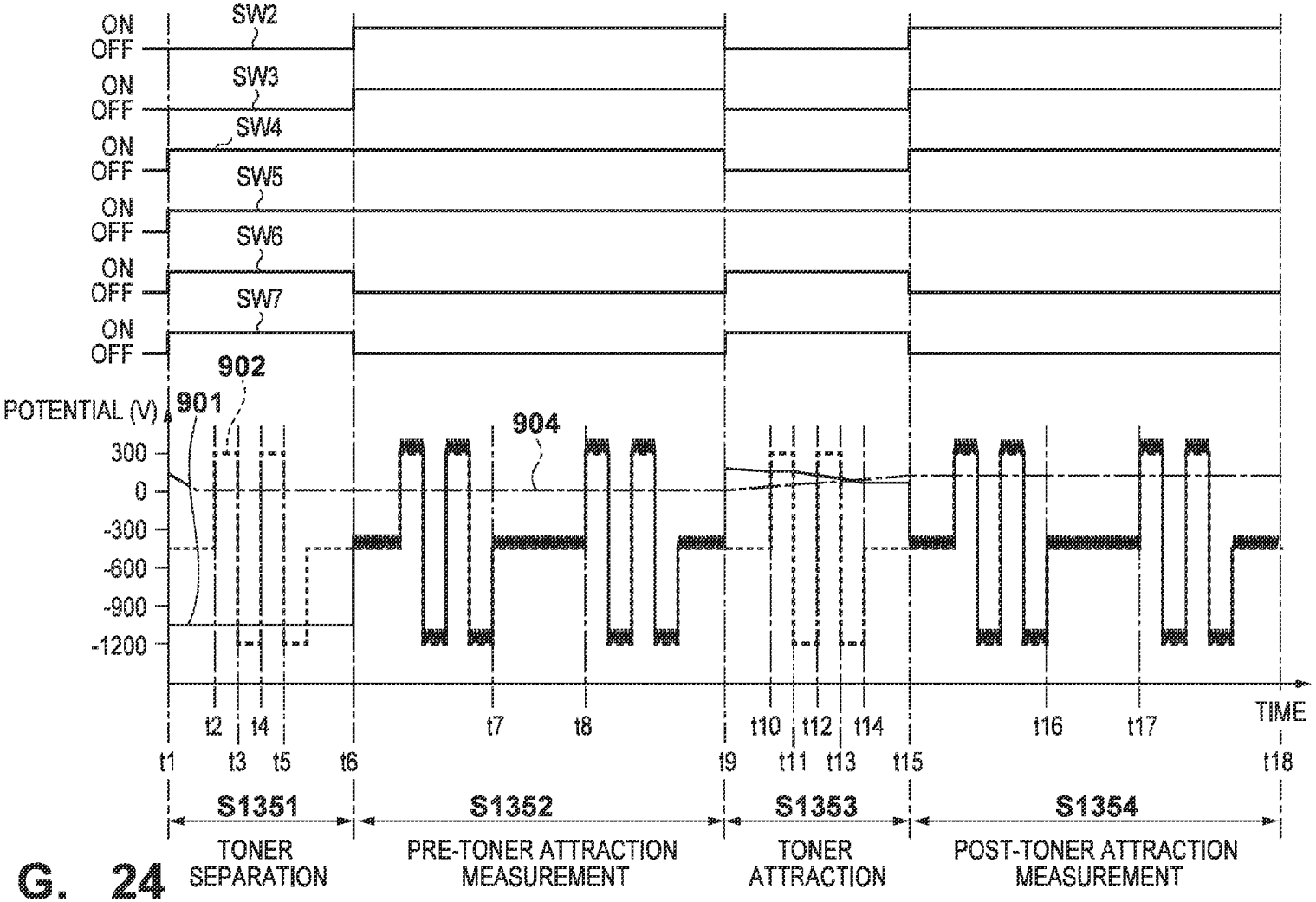
FIG. 24 is a timing chart according to the second embodiment.

FIG. 23 is a circuit diagram according to the present embodiment, and FIG. 24 is a timing chart according to the present embodiment. In the circuit diagram shown in FIG. 23, there are two differences from the first embodiment, namely that (1) the Q measurement capacitor C1 is absent and (2) the Q measuring circuit 1102 measures the potential difference V2 between both ends of the excessive voltage protection capacitor Cv.

In the timing chart shown in FIG. 24, a dot-dash line 904 indicates the potential of the excessive voltage protection capacitor Cv.

Figure 25:
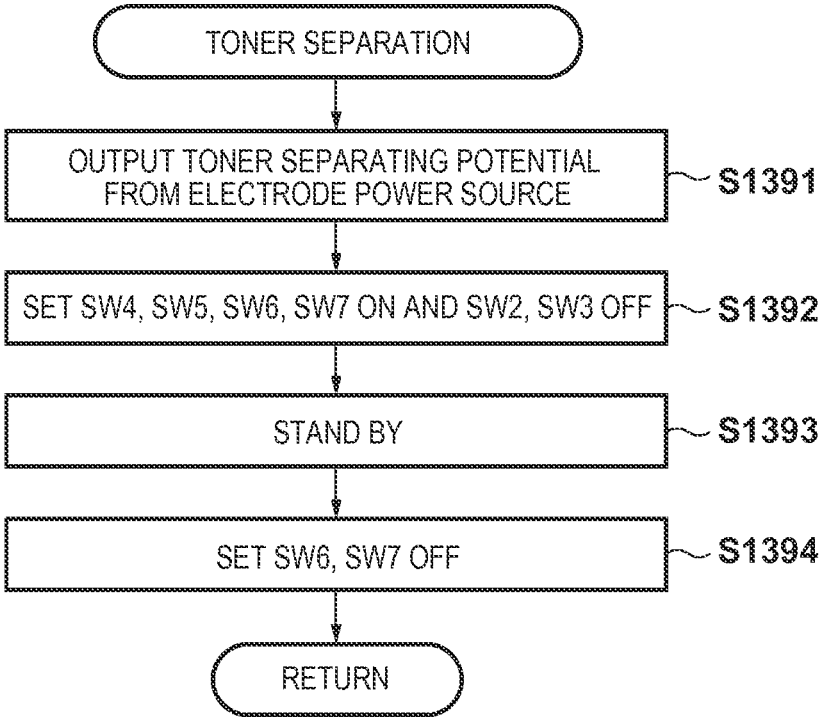
FIG. 25 is a flowchart illustrating a toner separation sequence according to the second embodiment.

FIG. 25 is a flowchart illustrating a toner separation sequence (S1351) according to the second embodiment. The difference from the first embodiment is that when the sequence is started, the Q/M measuring unit 1101 sets the switch SW4 and the switch SW5 to on, and applies the toner separating potential −1050 V to the toner attracting surface electrode 121 from the electrode power source 1104. The toner is separated from the toner attracting surface electrode 121 at time t2 to t3 and t4 to t5 in FIG. 24.

Figure 26:
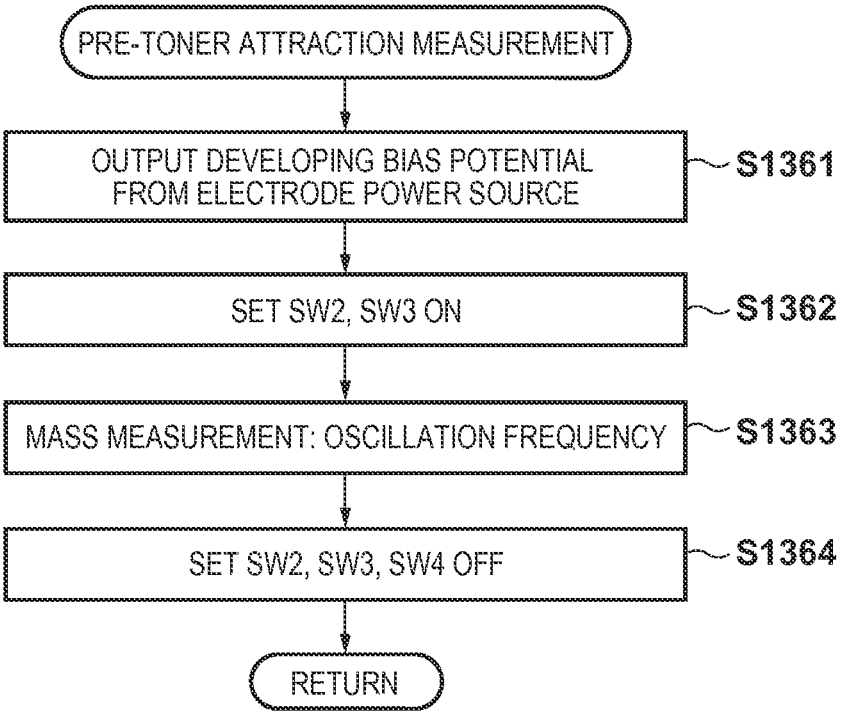
FIG. 26 is a flowchart illustrating a pre-toner attraction measurement sequence according to the second embodiment.

FIG. 26 is a flowchart illustrating a pre-toner attraction measurement sequence (S1352) according to the second embodiment. The difference from the first embodiment is that in S1363, only the pre-toner attraction frequency f1 is measured. Because the excessive voltage protection capacitor Cv that measures the amount of electric charge Q is not charged to the toner attraction potential, the potential is 0 V due to discharge at the time of toner separation, and thus the pre-toner attraction potential V1 need not be measured.

Figure 27:
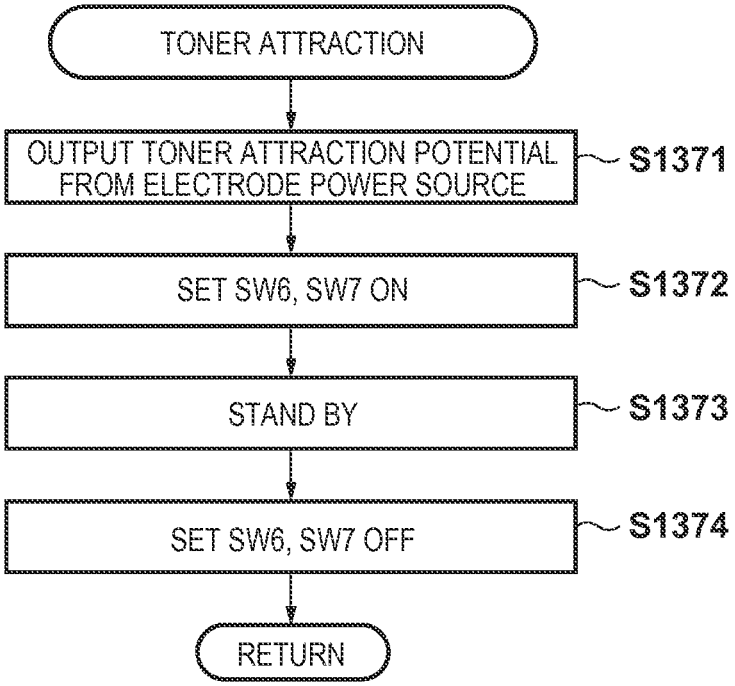
FIG. 27 is a flowchart illustrating a toner attracting sequence according to the second embodiment.

FIG. 27 is a flowchart illustrating a toner attracting sequence (S1353) according to the second embodiment. The differences from the first embodiment are that the switch SW4 is off and the switch SW5 is on. If the switch SW5 is on, the toner attracting potential +150 V is applied only to the toner non-attracting surface electrode 122. If the switch SW4 is off, the toner attracting potential +150 V is not applied to the toner attracting surface electrode 121.

Figure 8:
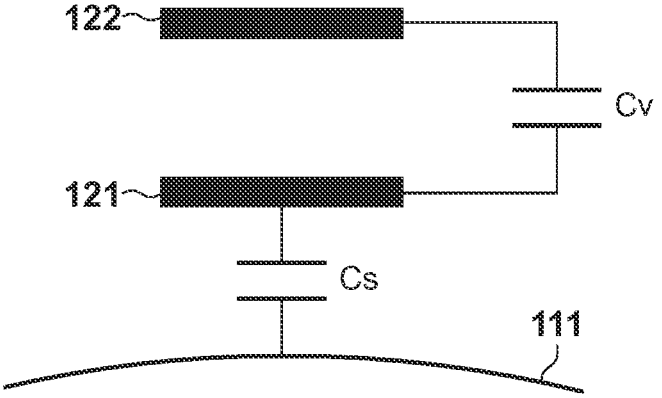
FIG. 8 is an equivalent circuit diagram illustrating the QCM sensor and the vicinity of a developing sleeve.

Next, a method for attracting the toner without applying the toner attracting potential +150 V to the toner attracting surface electrode 121 will be described. The toner attracting surface electrode 121 and the developing sleeve 111 oppose each other with air therebetween, and thus can be considered to be a capacitor equivalent circuit. Assuming a diameter of the toner attracting surface electrode 121 is 3.2 mm, a gap between the toner attracting surface electrode 121 and the developing sleeve 111 is 0.3 mm, and the dielectric constant of air is $8.86\times10^{-12}$, a capacitance Cs is 0.23 pF. Furthermore, assuming the capacitance of the excessive voltage protection capacitor Cv is 1000 pF, Cv and Cs are equivalent to circuits connected in serial, as shown in FIG. 8.

Note that here, the capacitance Cx, shown in FIG. 7, of the QCM sensor 120 is 1.1 pF, which is lower than the 1000 pF of Cv, and thus Cx is omitted. In the case where the potential difference between the toner non-attracting surface electrode 122 and the developing sleeve 111 is 1000 V, when the potential between both ends of the excessive voltage protection capacitor Cv is calculated as 1000*Cs/(Cs+Cv), Vv is 0.23 V. In other words, the potential of the toner attracting surface electrode 121 is a potential that is different from the toner attraction potential applied to the toner non-attracting surface electrode 122 by 0.23 V.

For this reason, even if the toner attracting potential +150 V is not applied to the toner attracting surface electrode 121, the potential is essentially the same as the toner attraction potential +150 V applied to the toner non-attracting surface electrode 122, and thus the toner is attracted.

The timing chart shown in FIG. 24 shows an example in which the potential of the excessive voltage protection capacitor Cv (the dot-dash line 904) becomes +100 V at a time t15, when the toner attraction has finished.

Figure 28:
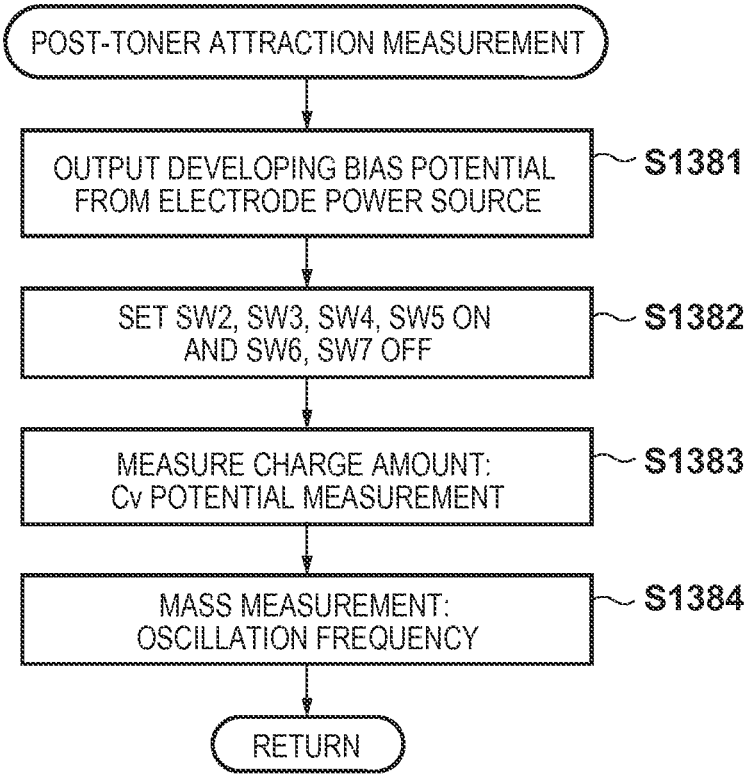
FIG. 28 is a flowchart illustrating a post-toner attraction measurement sequence according to the second embodiment.

FIG. 28 is a flowchart illustrating post-toner attraction measurement (S1354) according to the second embodiment. Because the capacitor C1 is absent, in S1383, the potential between both ends of the excessive voltage protection capacitor Cv is measured as the post-toner attraction potential V2.

In addition, the method for measuring the amount of electric charge Q is different from that used in the first embodiment. Although the amount of electric charge Q is calculated from the difference between the pre-toner attraction potential V1 and the post-toner attraction potential V2 in the first embodiment, the potential V1 of the excessive voltage protection capacitor Cv before the toner attraction is 0 V in the present embodiment, and thus the amount of electric charge Q is calculated using the following Formula (7).

$$Q=Cv*V2 \tag{7}$$

According to the present embodiment, an advance process for charging the toner attraction potential is unnecessary, and a single capacitor can function as both the excessive voltage protection capacitor and the capacitor for measuring the amount of electric charge Q.

Third Embodiment

Although the first embodiment describes a configuration in which the developing bias potential is controlled in accordance with an output waveform that alternates between a pulse period and a blank period, the present embodiment describes a method for measuring the toner charge amount in the case where a direct current (DC) potential is applied as the developing bias potential.

Figure 29:
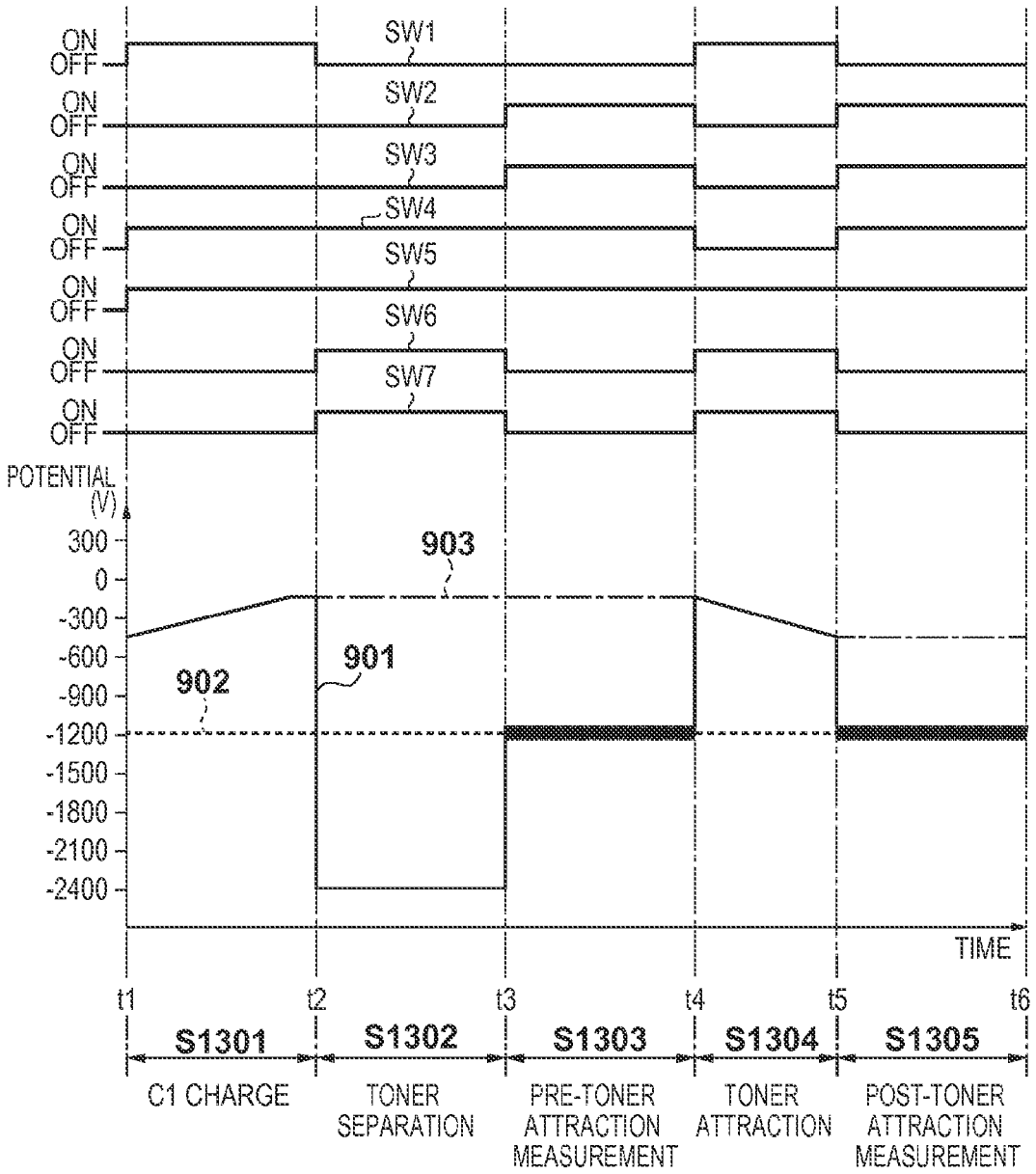
FIG. 29 is a timing chart according to a third embodiment.

FIG. 29 is a timing chart according to the present embodiment. The developing bias potential is, as indicated by the dotted line 902, a constant value of −1200 V. Here, the toner attracting potential may be a value at which the toner adheres uniformly to the surface of the toner attracting surface electrode 121 when the toner is attracted to the toner attracting surface electrode 121 from the developing sleeve 111. In the present embodiment, the toner attracting potential is −150 V, for example. Note that the toner attracting potential is not limited to this value, and the toner attracting potential for causing the toner to adhere uniformly to the toner attracting surface electrode 121 may be determined in advance through experimentation.

In the toner separation occurring after charging, the potential of the toner attracting surface electrode 121 is set to −1200 V lower than the developing bias potential (the dotted line 902) in order to return the toner from the toner attracting surface electrode 121 to the developing sleeve 111. In the first embodiment, the toner separating potential for separating the toner is set to −1050 V when the developing bias potential is +300 V. On the other hand, in the present embodiment, the developing bias potential is a constant value −1200 V, and thus the toner is separated at a toner separating potential −2400V.

The developing bias potential does not vary in the pre-toner attraction measurement and the post-toner attraction measurement sequences. Accordingly, the pre-toner attraction potential V1 and the pre-toner attraction frequency f1 can be measured immediately after the start of the measurement sequence at time t3, and the post-toner attraction potential V2 and the post-toner attraction frequency f2 can be measured immediately after the start of the measurement sequence at time t5.

During toner attraction, the attraction begins immediately after the start of time t4, and the toner attraction surface potential (the solid line 901) drops from −150 V to −400 V. The post-toner attraction measurement sequence and the like are the same as in the first embodiment, and thus descriptions will be omitted here.

According to the present embodiment, the developing bias potential is a DC current, and thus the amount of time required for the Q measurement capacitor C1 charging sequence, the toner attracting sequence, and so on can be reduced.

Fourth Embodiment

Although the first embodiment describes a configuration in which the developing bias potential is controlled in accordance with an output waveform that alternates between a pulse period and a blank period, the present embodiment describes a method for measuring the toner charge amount in the case where a sine wave potential is applied as the developing bias potential.

Figure 30:
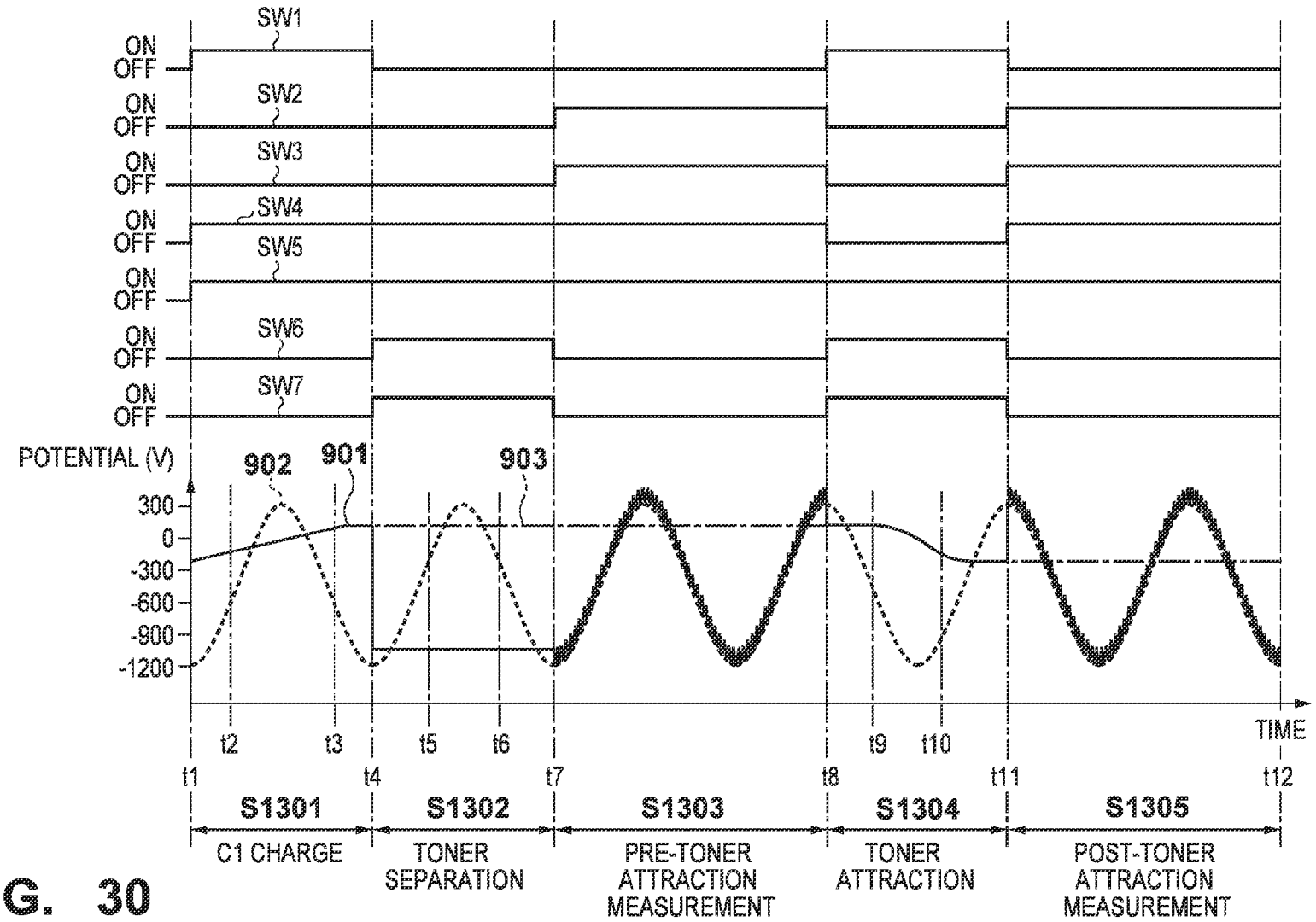
FIG. 30 is a timing chart according to a fourth embodiment.

FIG. 30 is a timing chart according to the present embodiment. The developing bias potential (the dotted line 902) is a sine wave whose positive-side potential (maximum value) is +300 V and whose negative-side potential (minimum value) is −1200 V.

The post-charging toner separation is carried out when the developing bias potential is higher than the −1050 V toner separating potential. In addition, the timing of the toner separation is determined in accordance with the potential difference between the toner separating potential and the developing bias potential. Accordingly, the toner separation is carried out from time t5 to t6 in FIG. 30. The developing bias potential varies at a low frequency in the pre-toner attraction measurement and the post-toner attraction measurement. Accordingly, the pre-toner attraction potential V1 and the pre-toner attraction frequency f1 can be measured immediately after the start of the measurement sequence at time t7, and the post-toner attraction potential V2 and the post-toner attraction frequency f2 can be measured immediately after the start of the measurement sequence at time t11.

The toner attraction is carried out when the developing bias potential is lower than the toner attracting potential +150 V. In addition, the timing of the toner attraction is determined in accordance with the potential difference between the toner separating potential and the developing bias potential. Accordingly, in FIG. 30, the toner attraction is carried out during a period where the potential difference between the potential of the toner attracting surface electrode 121 and the developing bias potential is high (that is, from time t9 to t10). The post-toner attraction measurement sequence and the like are the same as in the first embodiment, and thus descriptions will be omitted here.

According to the present embodiment, the developing bias potential is a sine wave, and thus the toner separation, attraction, and so on are carried out in proportion to the potential difference between the electrode potential and the developing bias potential. Accordingly, in the present embodiment, the amount of time required for the Q measurement capacitor C1 charging sequence, the toner attracting sequence, and so on can be reduced more than in the first embodiment.

Fifth Embodiment

Although the first embodiment describes a configuration in which the developing bias potential is controlled in accordance with an output waveform that alternates between a pulse period and a blank period, the present embodiment describes a method of measuring the toner charge amount in the case where the developing bias potential is controlled in accordance with an output waveform that does not have a blank period (called a "continuous pulse waveform" hereinafter).

Figure 31:
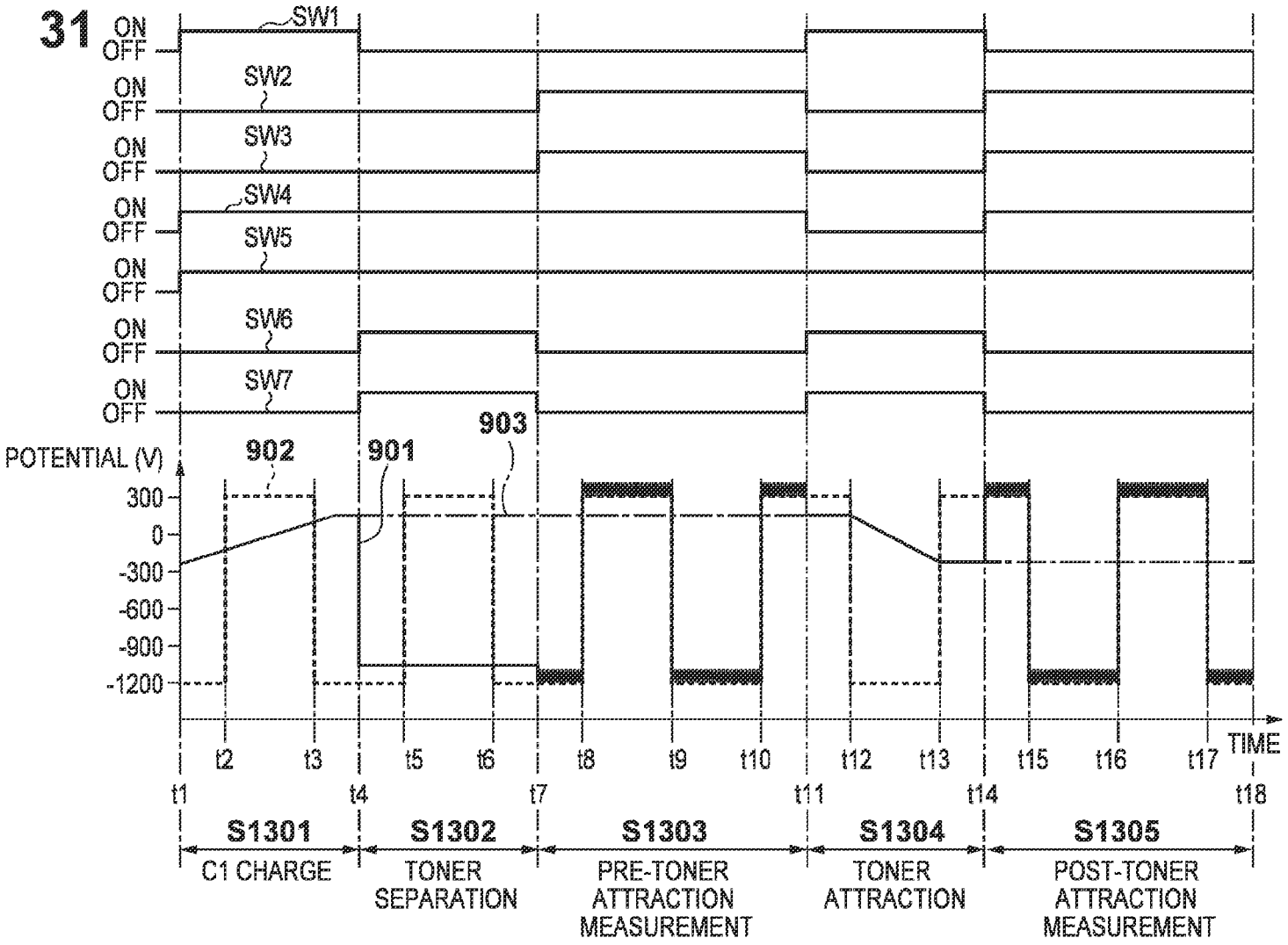
FIG. 31 is a timing chart according to a fifth embodiment.

FIG. 31 is a timing chart according to the present embodiment. The developing bias potential is controlled in accordance with a continuous pulse waveform whose positive-side potential is +300 V and whose negative-side potential is −1200 V.

The post-charging toner separation is carried out when the developing bias potential is +300 V and is thus higher than the −1050 V toner separating potential. Accordingly, the separation of the toner from the toner attracting surface electrode 121 is carried out from time t5 to t6 in FIG. 31. The pre-toner attraction measurement and the post-toner attraction measurement are carried out during a period when the developing bias potential is +300 V or −1200 V. In FIG. 31, measurement is carried out at time t5 to t6 and t15 to t16. Note that measurement may be carried out at t6 to t7 instead of t5 to t6. Likewise, measurement may be carried out at t16 to t17 instead of t15 to t16.

The toner attraction, meanwhile, is carried out during a period when the developing bias potential is −1200 V, which is lower than the toner attracting potential (+150 V). In FIG. 31, attraction is carried out at time t12 to t13. The post-toner attraction measurement sequence and the like are the same as in the first embodiment, and thus descriptions will be omitted here.

According to the present embodiment, the measurement can, as in the first embodiment, be carried out during a period in which the developing bias potential does not change, even if the developing bias potential is a continuous pulse waveform. In the first embodiment, measurement cannot be carried out in the blank period and in the pulse period between the stated blank period and the next blank period. However, in the present embodiment, the measurement can be carried out in both a period when the pulse is +300 V and when the pulse is −1200 V, and thus the present embodiment enables the same number of measurements to be carried out in a shorter amount of time than in the first embodiment in the case where a plurality of measurements are carried out.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiments of the present invention, and by a method performed by the computer of the system or apparatus by, for example, reading out and executing the computer executable instructions from the storage medium to perform the functions of one or more of the above-described embodiments. The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-089617, filed Apr. 22, 2013, which is hereby incorporated by reference herein in its entirety.

What is claimed is:

1. A detection device for detecting a charge amount of toner on a developing material carrier, the device comprising:

an assembly including a quartz oscillator and a first electrode and a second electrode attached to the quartz oscillator;

a first capacitor connected in series to the assembly;

a first switch provided between the assembly and the first capacitor;

a second capacitor connected in parallel with the assembly;

a second switch connected in parallel with the assembly and connected in series to the second capacitor;

a controller configured to control the first switch and the second switch;

a first detection unit configured to detect a potential difference between both ends of the first capacitor; and a second detection unit configured to detect an oscillation frequency of the quartz oscillator, wherein in the case where the toner on the developing material carrier is caused to adhere to the first electrode, the controller is configured to connect the assembly to the first capacitor using the first switch and connect the assembly to the second capacitor using the second switch, and wherein in the case where the second detection unit detects the oscillation frequency of the quartz oscillator, the controller is configured to disconnect the assembly from the first capacitor using the first switch and disconnect the assembly from the second capacitor using the second switch.

2. The detection device according to claim 1, further comprising:

a supply unit configured to supply a voltage to the first electrode, wherein the controller is configured to disconnect the assembly from the first capacitor using the first switch before the second detection unit detects the oscillation frequency of the quartz oscillator, and the supply unit is configured to supply, in a state in which the assembly is disconnected from the first capacitor by the first switch, the voltage to the first electrode so that the toner adhering to the first electrode separates from the first electrode.

3. The detection device according to claim 1, further comprising:

a supply unit configured to supply a voltage to the first electrode, wherein the supply unit is configured to supply the voltage to the first electrode so that a surface potential of the first electrode is synchronized with a surface potential of the developing material carrier in the case where the second detection unit detects the oscillation frequency of the quartz oscillator.

4. The detection device according to claim 1, wherein the controller is configured to disconnect the assembly from the first capacitor using the first switch and disconnect the assembly from the second capacitor using the second switch in the case where the first detection unit detects the potential difference between both ends of the first capacitor.

5. The detection device according to claim 1, further comprising:

a charging unit configured to charge the first capacitor, wherein the charging unit is configured to charge the first capacitor before the toner on the developing material carrier is caused to adhere to the first electrode.

6. The detection device according to claim 1, wherein the first detection unit is configured to detect the potential difference between both ends of the first capacitor before the toner adheres and after the toner adheres.

7. The detection device according to claim 1, wherein the second detection unit is configured to detect the oscillation frequency of the quartz oscillator before the toner adheres and after the toner adheres.

8. An image forming apparatus comprising:

an image forming unit including a photosensitive member, an exposure unit configured to expose the photosensitive member to form a toner image, and a developing unit, including a bearing member configured to bear a toner, configured to develop an electrostatic latent image formed on the photosensitive member to form the toner image;

an assembly including a quartz oscillator and a first electrode and a second electrode attached to the quartz oscillator;

a first capacitor connected in series to the assembly;

a first switch provided between the assembly and the first capacitor;

a second capacitor connected in parallel with the assembly;

a second switch connected in parallel with the assembly and connected in series to the second capacitor;

a controller configured to control the first switch and the second switch;

a first detection unit configured to detect a potential difference between both ends of the first capacitor;

a second detection unit configured to detect an oscillation frequency of the quartz oscillator; and a determination unit configured to determine a charge amount of the toner on the first electrode based on the potential difference detected by the first detection unit and the oscillation frequency detected by the second detection unit, wherein in the case where the toner on the bearing member is caused to adhere to the first electrode, the controller is configured to connect the assembly to the first capacitor using the first switch and connect the assembly to the second capacitor using the second switch, and wherein in the case where the second detection unit detects the oscillation frequency of the quartz oscillator, the controller is configured to disconnect the assembly from the first capacitor using the first switch and disconnect the assembly from the second capacitor using the second switch.

9. The image forming apparatus according to claim 8, further comprising:

a supply unit configured to supply a voltage to the first electrode, wherein the controller is configured to disconnect the assembly from the first capacitor using the first switch before the second detection unit detects the oscillation frequency of the quartz oscillator, and wherein the supply unit is configured to supply, in a state in which the assembly is disconnected from the first capacitor by the first switch, the voltage to the first electrode so that the toner adhering to the first electrode separates from the first electrode.

10. The image forming apparatus according to claim 8, further comprising:

a supply unit configured to supply a voltage to the first electrode, wherein the supply unit is configured to supply the voltage to the first electrode so that a surface potential of the first electrode is synchronized with a surface potential of the bearing member in the case where the second detection unit detects the oscillation frequency of the quartz oscillator.

11. The image forming apparatus according to claim 8, wherein the controller is configured to disconnect the assembly from the first capacitor using the first switch and disconnect the assembly from the second capacitor using the second switch in the case where the first detection unit detects the potential difference between both ends of the first capacitor.

12. The image forming apparatus according to claim 8, further comprising:

a charging unit configured to charge the first capacitor, wherein the charging unit is configured to charge the first capacitor before the toner on the bearing member is caused to adhere to the first electrode.

13. The image forming apparatus according to claim 8, wherein the first detection unit is configured to detect the potential difference between both ends of the first capacitor before the toner adheres and after the toner adheres.

14. The image forming apparatus according to claim 8, wherein the second detection unit is configured to detect the oscillation frequency of the quartz oscillator before the toner adheres and after the toner adheres.

* * * * *